US008622031B2

(12) United States Patent
Watanabe

(10) Patent No.: US 8,622,031 B2
(45) Date of Patent: Jan. 7, 2014

(54) SYSTEM FOR SUPPLEMENTARY FUEL SUPPLY

(75) Inventor: Tsuyoshi Watanabe, Iwanuma (JP)

(73) Assignee: Walbro Engine Management, L.L.C., Tucson, AZ (US)

( * ) Notice: Subject to any disclaimer, the term of this patent is extended or adjusted under 35 U.S.C. 154(b) by 270 days.

(21) Appl. No.: 13/175,356

(22) Filed: Jul. 1, 2011

(65) Prior Publication Data

US 2011/0253102 A1 Oct. 20, 2011

Related U.S. Application Data

(63) Continuation-in-part of application No. 12/686,198, filed on Jan. 12, 2010.

(51) Int. Cl.
*F02M 13/06* (2006.01)
*F02M 9/12* (2006.01)

(52) U.S. Cl.
USPC ..... 123/1 A; 123/431; 123/198 A; 123/438; 123/351; 123/583

(58) Field of Classification Search
USPC ..... 123/436, 1 A, 198 A, 431, 400, 579, 583, 123/590, 351, 438
See application file for complete search history.

(56) References Cited

U.S. PATENT DOCUMENTS

| | | | | |
|---|---|---|---|---|
| 4,480,618 | A | 11/1984 | Kamifuji et al. | |
| 4,862,847 | A | 9/1989 | Kobayashi et al. | |
| 5,052,359 | A | 10/1991 | Hardwick et al. | |
| 5,060,617 | A | 10/1991 | Kojima et al. | |
| 6,293,524 | B1 | 9/2001 | Endo et al. | |
| 7,040,282 | B2 | 5/2006 | Andersson et al. | |
| 7,198,028 | B2 | 4/2007 | Andersson et al. | |
| 7,264,230 | B2 | 9/2007 | Burns et al. | |
| 2005/0098907 | A1 * | 5/2005 | Richard et al. | 261/39.1 |
| 2007/0028881 | A1 | 2/2007 | Nakata et al. | |

FOREIGN PATENT DOCUMENTS

| | | | |
|---|---|---|---|
| EP | 1353058 | A2 | 10/2003 |
| JP | 2001193618 | | 7/2001 |
| JP | 2006105137 | | 4/2006 |
| WO | WO2009138232 | A1 | 11/2009 |

OTHER PUBLICATIONS

Black; Bill, et al. "Basics of Voice Coil Actuators", BEI Motion Systems Company, Kimco Magnetics Division, Jul. 1993, 3 pages, California.
"Ultrasonic Piezoelectric Valves", 1 page.

* cited by examiner

*Primary Examiner* — Hai Huynh
(74) *Attorney, Agent, or Firm* — Reising Ethington P.C.

(57) ABSTRACT

Supply of supplementary fuel is controlled by activation of a valve in response to certain engine operating conditions or parameters. For example, the supplementary fuel may be supplied to facilitate starting and warming up a cold engine, or to cool and/or slow down an engine operating above a threshold speed.

15 Claims, 12 Drawing Sheets

SYSTEM FOR SUPPLEMENTARY FUEL SUPPLY

REFERENCE TO RELATED APPLICATIONS

This application is a continuation-in-part of U.S. patent application Ser. No. 12/686,198, filed Jan. 12, 2010 and incorporated herein by reference in its entirety.

TECHNICAL FIELD

The present disclosure relates generally to internal combustion engines and, more particularly, to supplying supplementary fuel to an engine.

BACKGROUND

Many small internal combustion engines are supplied with a combustible charge of air and fuel using a carburetor. A typical carburetor includes a body at least partially defining a liquid fuel chamber, an air and fuel mixing passage, and one or more fuel passages in communication between the fuel chamber and the air and fuel mixing passage. The fuel passages communicate with the mixing passage between an air inlet at an upstream end and an air-and-fuel mixture outlet at a downstream end. Typically, a choke valve is disposed in the air and fuel mixing passage near the upstream end to control a quantity of air flowing into the mixing passage during engine cold starting and warm up. A throttle valve is disposed in the air-and-fuel mixing passage near the downstream end to control a quantity or flow rate of the air-and-fuel mixture flowing out of the mixing passage to the operating engine.

SUMMARY

A method according to one implementation includes controlling supply of supplementary fuel through a supplementary fuel supply passage in a carburetor for an engine. An electromechanical valve is provided in fluid communication with the supplementary fuel supply passage. The electromechanical valve is powered as engine intake vacuum peaks.

According to another implementation, a system supplies supplementary fuel through a carburetor to an engine, and includes a supplementary fuel supply passage between a carburetor fuel chamber and a carburetor air-and-fuel mixing passage, and an electromechanical valve normally closing the passage. The system also includes a magneto device including a flywheel with a magnet group and a lamstack having a first leg carrying a coil, wherein the flywheel magnet group and the lamstack first leg are configured such that the electromechanical valve is powered to open the passage by current created by the magnet group rotating past the lamstack first leg as engine intake vacuum peaks.

According to a further implementation, a combustion engine includes an engine block defining a cylinder, and intake and exhaust passages in fluid communication with the cylinder, a crankshaft rotatably carried by the engine block, and a piston disposed in the cylinder and coupled to the crankshaft for translation within the cylinder to open and close the intake and exhaust passages. The engine also includes a carburetor including a fuel chamber, an air-and-fuel mixing passage in fluid communication with the intake passage, a primary fuel supply passage between the fuel chamber and the air-and-fuel mixing passage, a supplementary fuel supply passage between the fuel chamber and the air-and-fuel mixing passage, and an electromechanical valve normally closing the supplementary fuel supply passage. The engine further includes a magneto device including a flywheel coupled to the crankshaft, a magnet group carried by the flywheel, a lamstack including a first leg carrying a coil to power the electromechanical valve with current to open the supplementary fuel supply passage by the magnet group rotating past the lamstack first leg as vacuum peaks through the intake passage of the engine block.

According to yet another implementation, a carburetor includes a body defining an air and fuel mixing passage and carrying a throttle valve disposed in the mixing passage, the body also defining a main fuel supply passage in fluid communication with the mixing passage at a location upstream of the throttle valve and a supplementary fuel supply passage in fluid communication with the mixing passage at a location downstream of the throttle valve. The carburetor also includes a fuel metering assembly carried by the body and including a cover coupled to the body and a diaphragm disposed between the cover and the body and partially defining a fuel metering chamber, wherein the cover includes a first passage in fluid communication with the fuel metering chamber, a second passage in fluid communication with the supplementary fuel supply passage, and a valve seat therebetween. The carburetor further includes an electromechanical valve carried by the cover and including a valve in a normally closed position against the valve seat of the cover of the fuel metering assembly.

According to an additional implementation, a cover for a metering chamber of a carburetor having an air-and-fuel mixing passage includes a generally planar portion arranged to be coupled to a body of the carburetor, and a flange extending generally transversely from the generally planar portion and including at least a portion of a supplementary fuel supply passage.

According to still another implementation, there is provided a method of controlling supply of supplementary fuel through a supplementary fuel supply passage in a carburetor for an engine. The method includes supplying supplementary fuel during engine cranking, and further supplying supplementary fuel after engine cranking and during engine warmup until engine temperature meets engine temperature criteria and engine speed meets engine speed criteria.

According to a further implementation, there is provided a system to supply supplementary fuel through a carburetor to an engine. The system includes a supplementary fuel supply passage between a carburetor fuel chamber and a carburetor air-and-fuel mixing passage. The system also includes an electromechanical valve normally closing the passage and powerable to open the passage by current created in a valve power coil by a magnet group rotating past a lamstack leg around which the valve power coil is wound. The system further includes a power and control module including a thermal switch to cut off supply of current to the electromechanical valve when engine temperature exceeds a high temperature value.

BRIEF DESCRIPTION OF THE DRAWINGS

The following detailed description of exemplary embodiments and best mode will be set forth with reference to the accompanying drawings, in which.

DETAILED DESCRIPTION OF PREFERRED EMBODIMENTS

Figure 1:
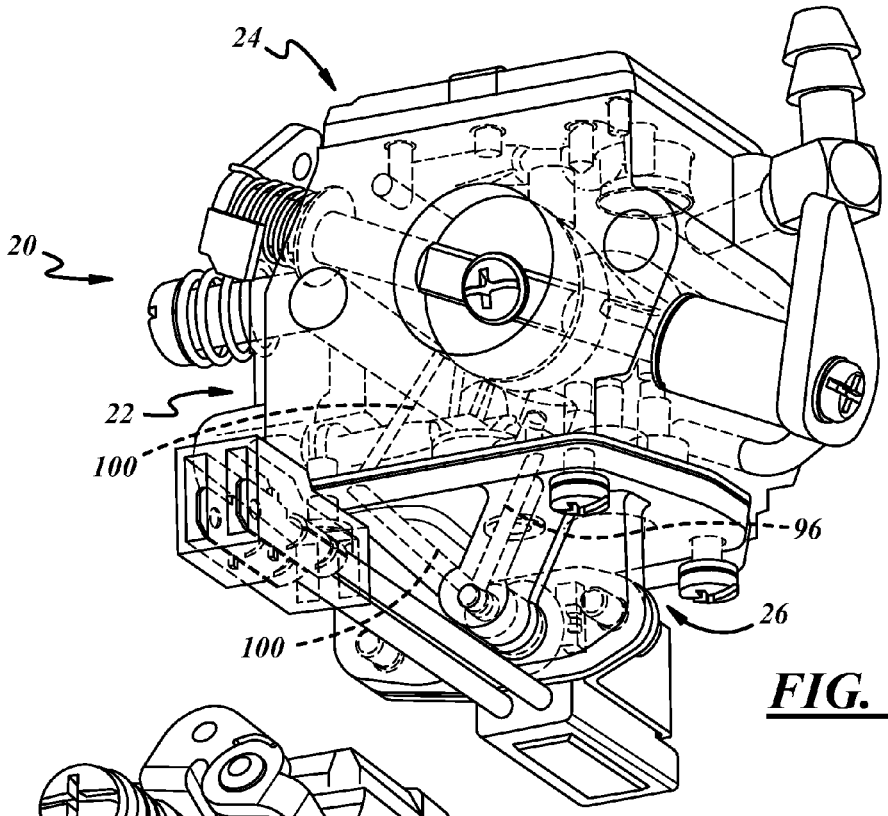
FIG. 1 is a perspective view of a presently preferred form of a carburetor.
Figure 2:
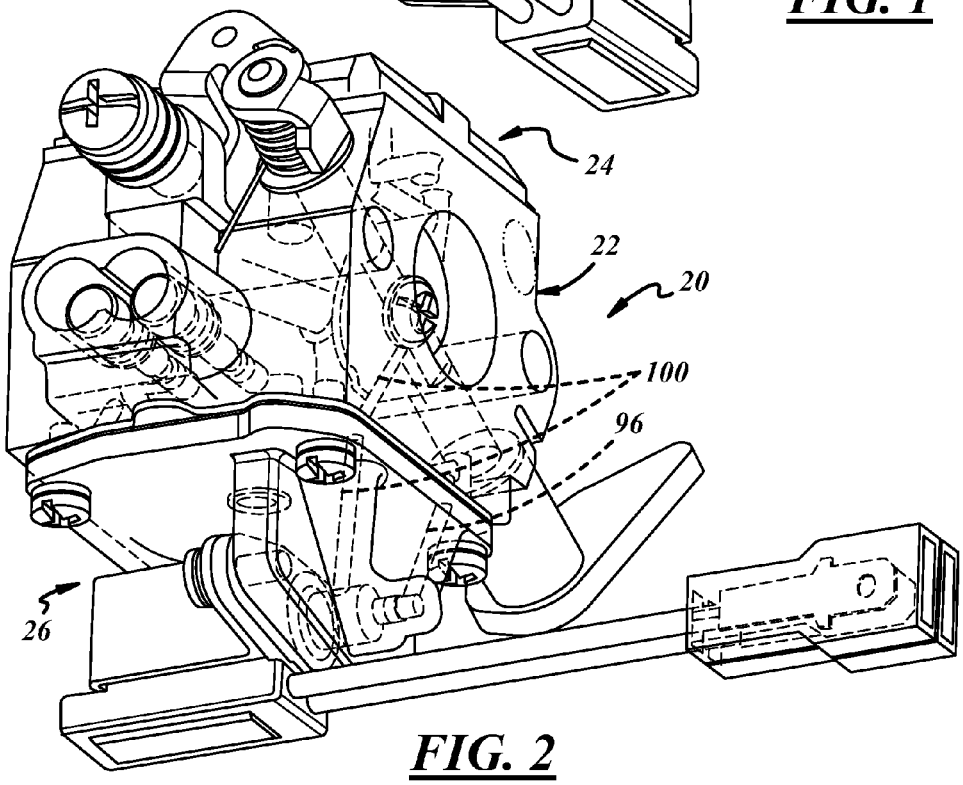
FIG. 2 is another perspective view of the carburetor of FIG. 1.
Figure 3:
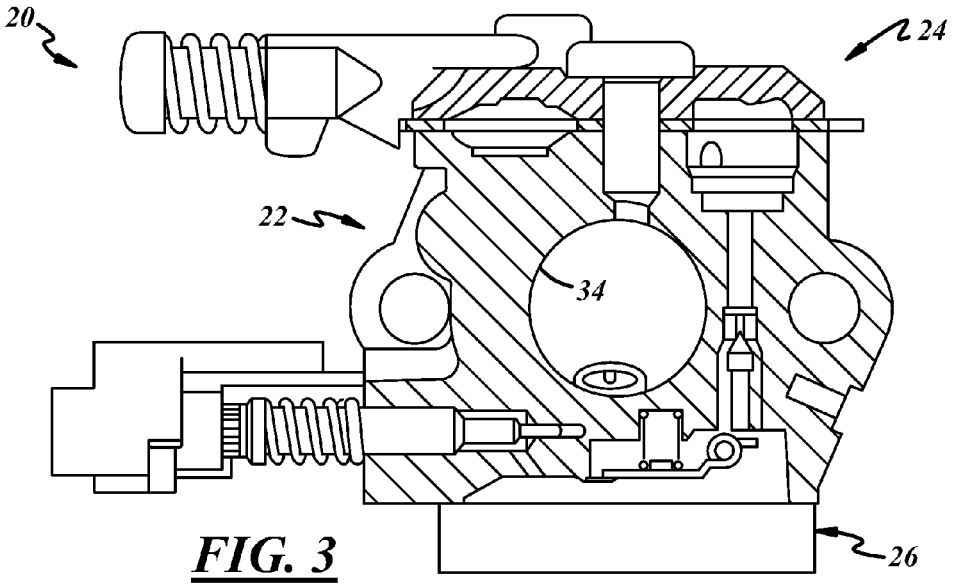
FIG. 3 is a cross-sectional view of the carburetor of FIG. 1.

Referring in more detail to the drawings, FIGS. 1 through 3 illustrate a carburetor 20 that may be used to provide a combustible charge of an air and fuel mixture to an engine (not shown). For example, the engine may be any suitable two-stroke engine, which may include a single cylinder engine with up to about 75 cc displacement for hand-held equipment such as hedge trimmers, grass trimmers, and chainsaws. Of course, other engine sizes may be used.

But whatever the application, the carburetor 20 generally may include a main body 22, a fuel pump assembly 24 for pumping liquid fuel, and a fuel metering assembly 26 for at least partially controlling the flow rate of liquid fuel in the main body 22. The carburetor 20 may be similar in many respects to that described in U.S. Pat. No. 6,293,524, which is assigned to the assignee hereof and is incorporated by reference herein in its entirety.

The main body 22 may be composed of any suitable material, for example, of cast aluminum or the like. The main body 22 provides structural support for the aforementioned assemblies 24, 26 and various other components and passages as will be described in further detail herein below. Externally, the main body 22 may carry a fuel inlet fitting 30 for connection to a fuel tank (not shown), and may also carry a fuel outlet fitting (not shown) for discharging purged fuel and any fuel vapor and air and returning them to the tank.

Figure 4:
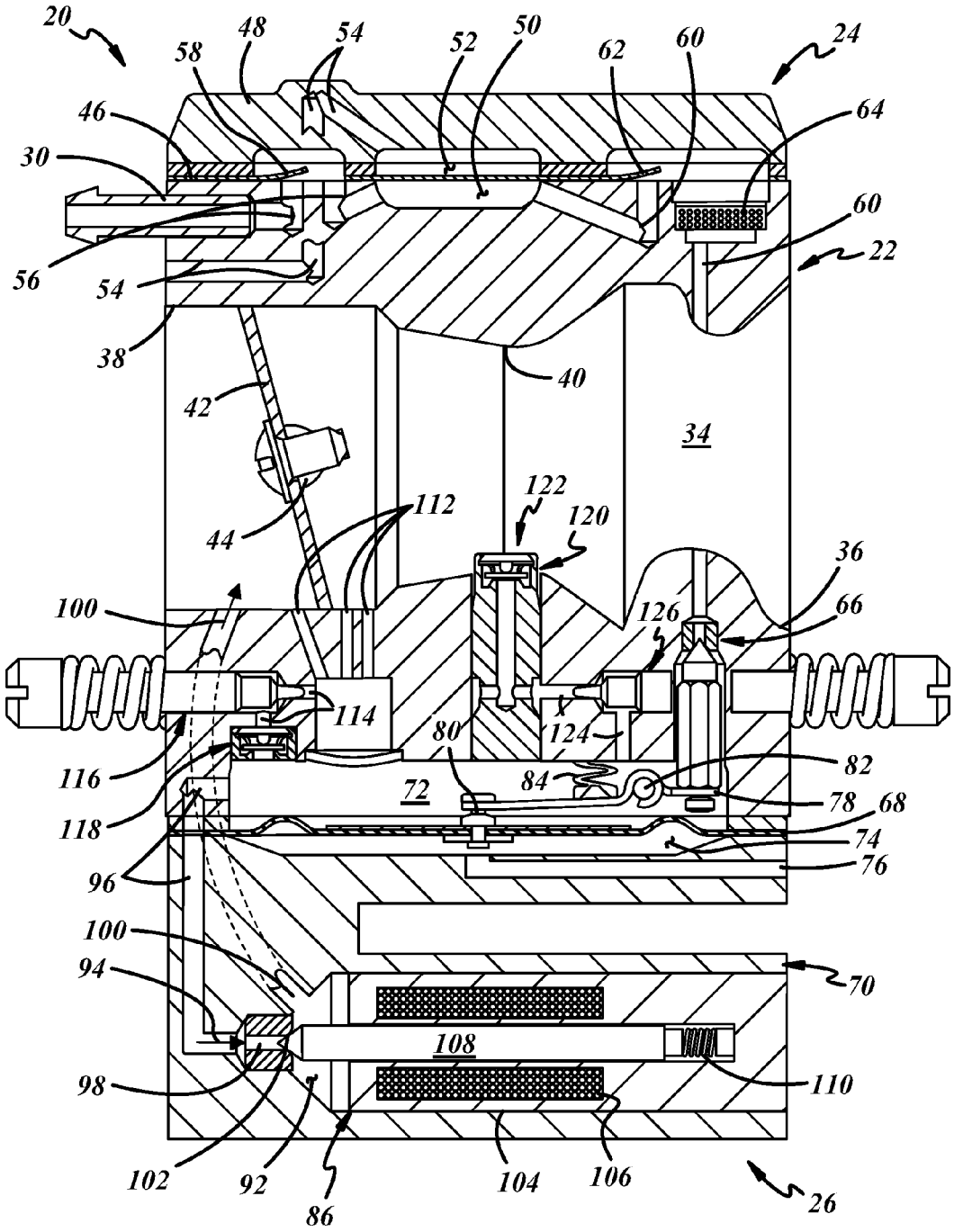
FIG. 4 is a fragmentary, sectional, schematic view of a portion of the carburetor of FIG. 1.

Internally, and referring now to FIG. 4, the main body 22 has an air and fuel mixing passage 34 with an air inlet 36 that may be in communication with an atmospheric air source such as an air filter (not shown) and an air and fuel mixture outlet 38 that may be in communication with an intake passage or manifold of the engine (not shown). The air and fuel mixing passage 34 may include a venturi 40 downstream of the inlet 36 and upstream of the outlet 38. A throttle valve 42 is received in the mixing passage downstream of the venturi 40 and may be mounted on a throttle shaft 44 extending transversely through the passage 44 and journalled for rotation in the main body 22.

As shown in FIG. 4, the fuel pump assembly 24 may have a flexible membrane or diaphragm 46 received and sealed between an upper face of the main body 22 and a lower face of an upper cover 48. The diaphragm 46 defines part of a pump chamber 50, and part of a pulse chamber 52 to which pressure and vacuum pulses in a crankcase of the operating engine (not shown) are introduced through a pulse passage 54 (shown fragmented) to flex or actuate the diaphragm 46.

The pump assembly 24 may use vacuum and pressure pulses from an engine crankcase to move the diaphragm 46 back and forth. Flexing of the diaphragm 46 toward the pulse chamber 52 expands the volume of the pump chamber 50 to create a vacuum therein to draw liquid fuel from a fuel tank (not shown) through the fitting 30, a fuel inlet passage 56 including a one-way check valve 58 therein, and into the pump chamber 50. In contrast, flexing of the diaphragm 46 toward the pump chamber 50 compresses the volume of the chamber 50 to pressurize the liquid fuel for delivery from the pump chamber 50 through a fuel outlet passage 60 including a one-way check valve 62 and a screen 64 therein, to the fuel metering assembly 26. The check valves 58, 62 may be integral portions of the diaphragm 46.

As shown in FIG. 4, at the bottom of the carburetor 20, the fuel metering assembly 26 has a flexible membrane or metering diaphragm 68 received and sealed between a lower face of the main body 22 and a cover 70. The metering diaphragm 68 defines part of a fuel metering chamber 72 on one side of the metering diaphragm 68 and an atmospheric air chamber 74 on its other side. The air chamber 74 communicates with the atmosphere outside of the carburetor 20 through a passage 76 in the cover 70. A metering valve 66 is opened and closed to control the admission of fuel to the fuel metering chamber 72 by movement of the metering diaphragm 68. The metering diaphragm 68 is operably connected to the metering valve 66 by a lever 78. The lever 78 is coupled at one end to the metering valve 66 and at another end cooperatively coupled to a projection 80 attached to the center of the metering diaphragm 68 and between its ends the lever 78 is pivotally mounted on a support shaft 82. The metering valve 66 is yieldably biased to its closed position by a spring 84 bearing on the lever 78.

The force of the metering spring 84 against the metering lever 78 holds the metering valve 66 against its seat and prevents fuel from entering the metering chamber 72. The metering diaphragm 68 may be composed of a flexible convoluted material to allow for sufficient movement. As the engine runs, fuel is drawn from the metering chamber 72 into the carburetor mixing passage 34. This causes the metering diaphragm 68 to advance and contact the metering lever 78. The pressure of the metering diaphragm 68 against the lever 78 overrides the force imposed by the spring 84 on the metering valve 66. The fuel pressure from the pump chamber 50 is then great enough to overcome the spring pressure on the metering valve 66 and fuel flows into the metering chamber 72.

Figure 5:
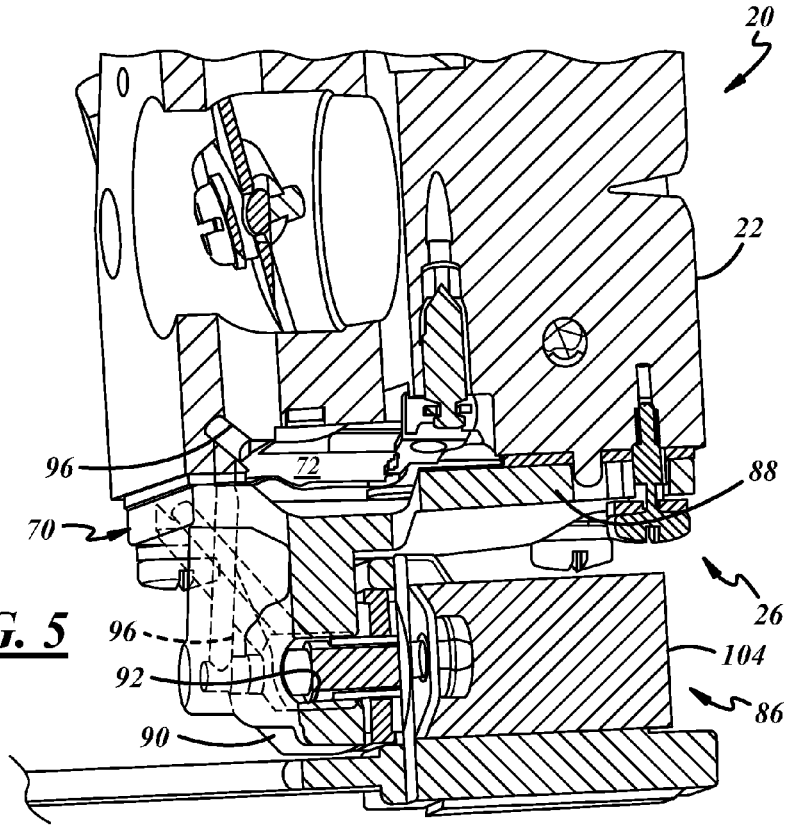
FIG. 5 is a fragmentary, sectional view of the carburetor of FIG. 1.

Referring to FIG. 5, the metering assembly 26 also includes a supplementary fuel supply assembly, which includes the cover 70 and an electromechanical valve 86 coupled in fluid communication to the cover 70. The cover 70 may be constructed in any suitable manner and composed of any suitable material. For example, the cover 70 may be cast from aluminum. The cover 70 includes a generally planar portion 88 coupled in any suitable manner to the carburetor body 22, and a flange 90 extending generally transversely from the generally planar portion 88. The flange 90 includes a supplementary fuel supply passage 92, which may include a first portion 94 in fluid communication with a valve inlet passage 96 that extends through a portion of the flange 90 and is in fluid communication with the metering chamber 72. The supplementary fuel supply passage 92 may also include a second portion 98 in fluid communication with a valve outlet passage 100 that extends through a portion of the flange 90 and is in fluid communication with the air and fuel mixing passage 34 of the carburetor 20. A valve seat 102 may be located between the first and second portions 94, 98.

The electromechanical valve 86 includes a housing 104 that may be coupled to the flange portion 90 of the cover 70 in any suitable manner, a coil 106 disposed in the housing 104, and a valve member 108 operatively coupled to the coil 106 and slidingly disposed in the passage 92 of the cover 70 to a normally closed position wherein a forward portion of the valve member 108 seats against the valve seat 102. A spring 108 may be disposed, for example, between a rearward end of the valve member 108 and a corresponding portion of the housing 104 to bias the valve member 108 toward the seat 102. The valve 86 is operable to open and close fluid communication between the inlet and outlet passages 96, 100 of the cover 70 to initiate supply and terminate supply of supplementary fuel through the supplementary fuel supply passage 92 in the carburetor main body. The valve 86 may be a carburetor solenoid, which is generally known to those of ordinary skill in the art, and the description and drawings of the solenoid described in U.S. Pat. No. 7,264,230 is hereby incorporated by reference herein. In other embodiments, the valve 86 may be any suitable device to allow, block, or otherwise control flow of fluid. For example, the valve 86 may include solenoid devices, servo devices, piezoelectric devices, or any other device suitable for use in a carburetor.

In addition to the supplementary fuel supply apparatus and path, those of ordinary skill in the art will recognize that a low speed fuel supply apparatus and path may also be used. For example, one or more low speed fuel passages 112 may open into the mixing passage 34 upstream and/or downstream of the throttle valve 44, for example when the valve 44 is in its idle or closed positions. The low speed fuel may be supplied from the metering chamber 72 via a branch passage 114 in communication with the port(s) 112, via an adjustable low speed fuel regulating needle valve 116 and a check valve 118.

Moreover, when the supplementary fuel supply apparatus is not used to supply fuel, such as when the throttle valve 44 is opened, liquid fuel may be supplied from the fuel metering chamber 72 through a primary fuel supply apparatus and path. The primary fuel supply apparatus may include a high speed fuel nozzle 120 carried by the body 26 and opening into the mixing passage 34, a check valve 122 carried by the nozzle 120, and a branch passage 124 via an adjustable fuel regulating needle valve 126.

Figure 6:
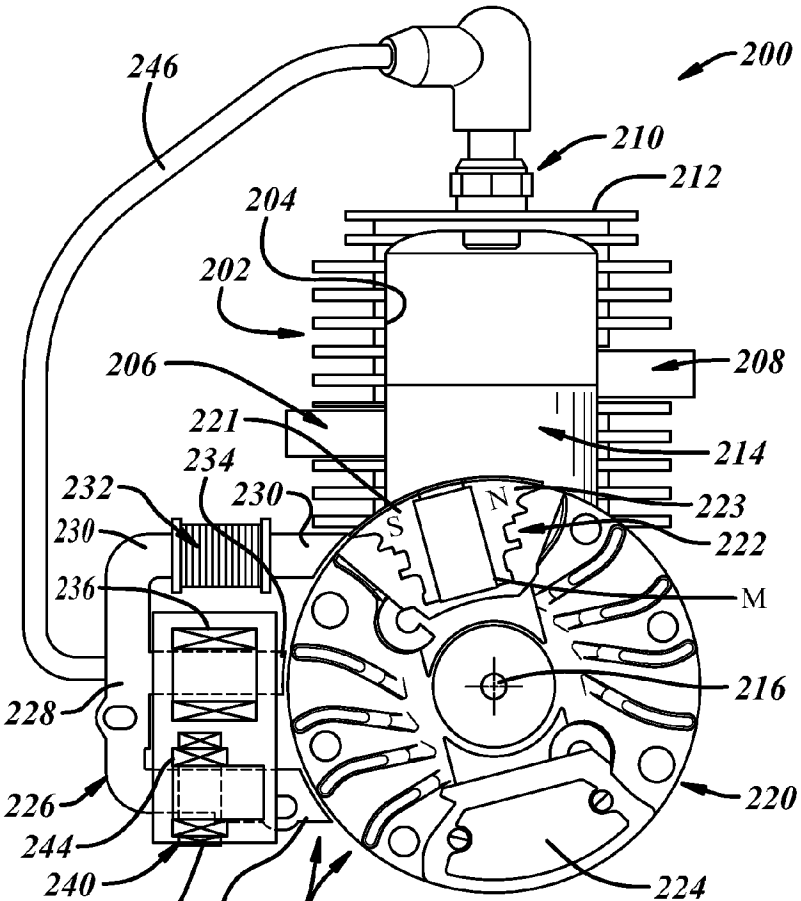
FIG. 6 is a partial schematic view of a presently preferred form of an engine, illustrating a closed intake passage position of a piston and a magneto device.

Referring now to FIG. 6, an engine 200 includes a cylinder block 202 defining a cylinder 204, and an intake port or passage 206 and an exhaust port or passage 208 in fluid communication with the cylinder 204. The engine 200 also includes a spark plug 210 coupled through a cylinder head 212 and being disposed partly within the cylinder 204. The engine 200 further includes a piston 214 disposed in the cylinder 204 and coupled to a crankshaft 216 for translation in the cylinder 204 to open and close the intake and exhaust passages 206, 208. The crankshaft 216 may be rotatably carried by the engine block 202.

The engine 200 additionally may include a power and control module (PCM) 218. The PCM 218 may be a multi-functional device, for example, to power the electromechanical valve 86 of the carburetor 20, to produce engine ignition spark to ignite the combustible charge, and/or to control at least some functionality of at least the carburetor 20. The PCM 218 may include a magneto device that may include a flywheel 220 coupled to the crankshaft 216 and carrying a magnet group 222 and an oppositely disposed counterweight 224. The magnet group 222 may include poles 221, 223 and a permanent magnet M disposed therebetween.

The PCM 218 may further include a lamstack 226 disposed adjacent the periphery of the flywheel 220. The lamstack 226 may be a ferromagnetic part comprised of a stack of flat, magnetically-permeable, laminate pieces typically composed of steel or iron. The lamstack 226 may have a generally E-shaped configuration that includes a base 228 and a trio of legs extending from the base 228. The trio includes a first leg 230 carrying an auxiliary or valve power coil 232 to power the electromechanical valve 86 of the carburetor 20, a second leg 234 carrying a charge coil 236 for charging an ignition capacitor and/or an electronic processing device if desired, and a third leg 238 carrying a transformer 240 including a pair of closely-coupled windings 242 and 244 to create high voltage ignition pulses that are sent to the spark plug 210 via an ignition lead 246 for developing spark energy to initiate combustion.

The PCM 218 may also provide an engine crankshaft angular position and/or speed signal for use by the control module using hall-effect sensors (not shown) located in the PCM 218 and triggered by the rotating flywheel magnets in proximity to the PCM 218. In other words, crankshaft position may be observed using the hall-effect sensors or by observation of charge coil voltages induced from the rotating flywheel magnet(s) instead of or in addition to a separate crankshaft position sensor. Such signals may be used in determining engine speed and/or other engine timing.

The PCM may provide the required power for the valve 86 and any sensors, in addition to its own internal power needs. For example, in FIG. 6, the engine 200 is illustrated in a compression stroke wherein the piston 214 is moving toward the cylinder head 212 such that the intake passage 206 is closed and the exhaust passage 208 is partially open but being closed. Reciprocation of the piston 214 causes the crankshaft 216 to rotate and, thus, the flywheel 220 is rotating counterclockwise such that the magnet group 222 is approaching the first leg 230 of the lamstack 226. As the flywheel 220 rotates and the magnet group 222 passes by the lamstack legs 230, 234, 238, an electric current is induced in the corresponding coils 232, 236, 242, 244. More particularly, the valve power coil 232 is positioned so that the magnet group 222 is generally aligned with the corresponding lamstack leg 230 in synchronization with a maximum or peak vacuum through the intake passage 206. Accordingly, the valve 86 can be opened in synchronism with the timing of supplying the air-and-fuel mixture into the intake passage 206 and, thus, no battery for powering the valve 86 is required. Those of ordinary skill in the art will recognize that engine intake vacuum is synonymous with a maximum negative pressure below atmospheric pressure in the engine intake, or a greatest sub-atmospheric pressure in the engine intake, or a minimum absolute pressure in the engine intake.

Figure 11:
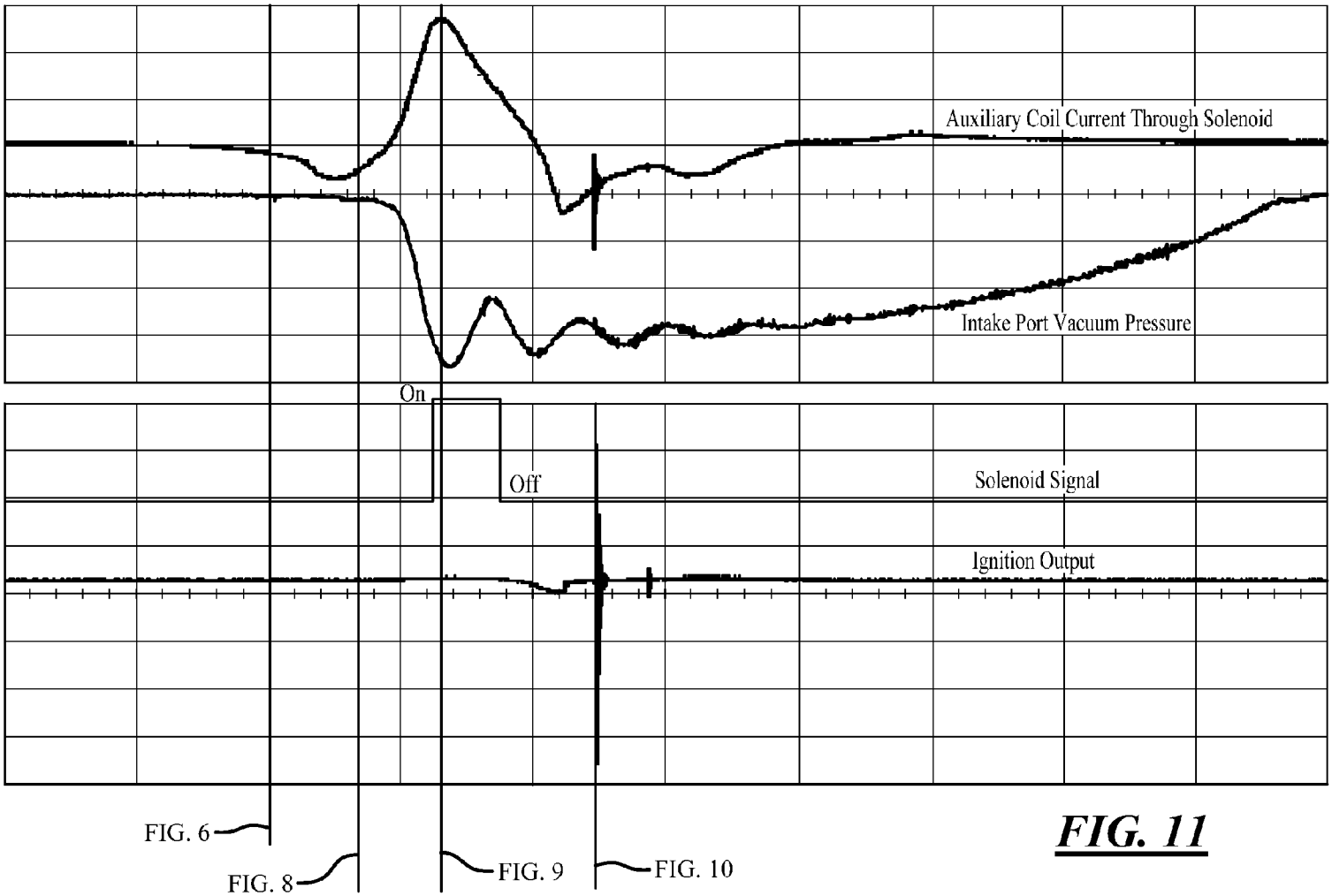
FIG. 11 is a graphical plot of electromechanical valve current, intake passage vacuum, electromechanical valve control signal, and ignition spark.

FIG. 11 illustrates plots of current through the electromechanical valve 86, vacuum through the intake passage 206, an electromechanical valve control signal, and ignition spark. The position of the piston and flywheel of FIG. 6 approximately corresponds to the FIG. 6 line in FIG. 11, wherein electromechanical valve current just begins to fluctuate due to the magnetic flux induced in the coil 232 by the approaching the first pole 221 of the magnet 222 group nearing the lamstack leg 230.

Figure 7:
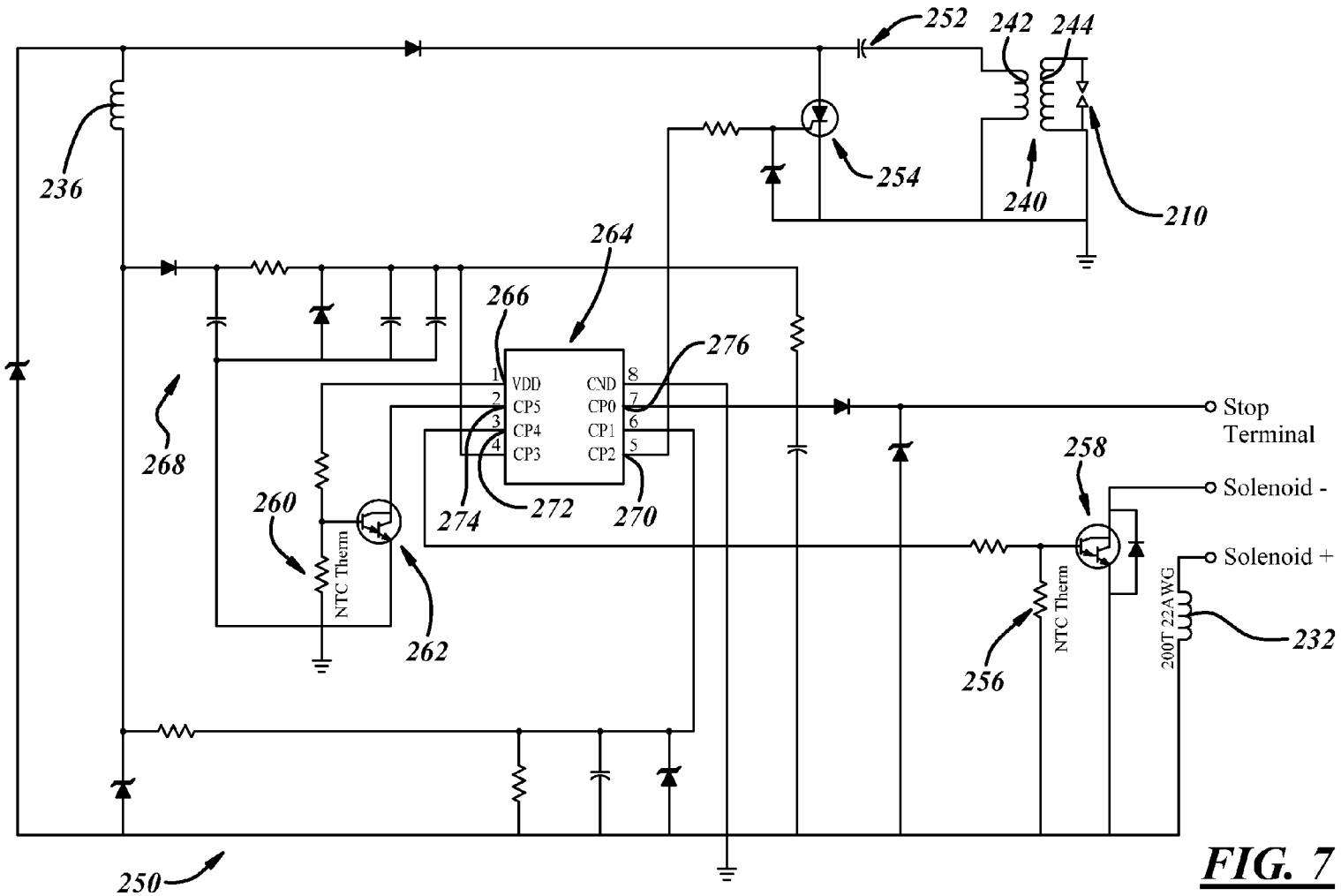
FIG. 7 is a schematic circuit diagram for control of ignition and supplementary fuel supply.

Turning now to FIG. 7, there is shown a schematic circuit diagram illustrating exemplary components of the PCM 218, including the valve power coil 232, the charge coil 236, the transformer 242, and a control circuit 250. It should be understood that numerous changes, including the addition, omission and/or substitution of various electrical components, could be made to this diagram as it is merely intended to provide a general overview of one possible implementation. The control circuit 250 may be implemented on a printed circuit board (PCB) or other circuit medium known to skilled artisans, and may be potted or otherwise hermetically sealed within a housing.

The control circuit 250 may use a number of different electrical components including, in this embodiment, an ignition capacitor 252, and a switching device 254 to discharge the ignition capacitor 252 for spark generation. The circuit 250 may also include a first thermal switch that may include a thermistor 256 and a transistor 258 to interrupt current flow to the valve 86 so as to terminate supplementary fuel supply when engine temperature exceeds a certain value, for instance, a high temperature value. Similarly, the circuit 250 may further include a second thermal switch that may include a thermistor 260 and a transistor 262 to initiate or continue current flow to the valve 86 so as to ensure supplementary fuel supply when engine temperature falls below another certain value, for instance, a low temperature value.

Accordingly, in the exemplary embodiment, supplementary or enrichment fuel supply may be varied by employing the thermal switches, which represent high and low temperature values or setpoints. Other embodiments may include employing a microprocessor, which can include an analog-to-digital converter for sensing actual temperature with a thermistor, converting a signal received from the thermistor to a temperature value, and cross-referencing the converted temperature value with electromechanical valve opening durations stored in memory. A cross-referenced valve opening duration corresponding to the actual temperature can then be used in powering the electromechanical valve. This latter embodiment permits use of more than two temperature setpoints for use in varying supplementary fuel supply, over an entire engine temperature range.

The transistors 258, 260 may include solid state devices, for example, pairs of high voltage bipolar transistors connected in a Darlington arrangement for high current gain. The switching device 254 may be a high current solid state switching device, such as a silicon controlled rectifier (SCR) or some other type of thyristor, and may be designed to discharge the ignition capacitor 252. In this embodiment, the switching device 252 is part of an energy discharge path that also includes the primary winding 244, the ignition capacitor 252, and ground.

The ignition circuit also includes an electronic processing device 264 that may execute various electronic instructions pertaining to a variety of tasks, such as ignition timing control, valve control, etc. The electronic processing device 264 may be a microcontroller, a microprocessor, an application specific integrated circuit (ASIC), or any other suitable type of analog or digital processing device known in the art. In the illustrated embodiment, the electronic processing device 264 is a microcontroller to process and store data and/or information like electronic instructions and variables. The processing device 264 may execute instructions that provide at least some of the functionality for the apparatus described herein. As used herein, the term instructions may include, for example, control logic, computer software and/or firmware, programmable instructions, or other suitable instructions.

Although not separately shown, any suitable memory device(s) may be coupled to the processing device 264 to provide storage for data, and/or for processor-executable instructions. The data and/or instructions may be stored, for example, as look-up tables, formulas, algorithms, maps, models, and/or any other suitable format. The memory may include, for example, RAM, ROM, EPROM, and/or any other suitable type of storage device.

The electronic processing device 264 may be powered at a power input 266 by the charge coil 236 via various electronic power conditioning components, including one or more capacitors 268 that smooth or otherwise regulate the energy induced in the charge coil 236. According to the embodiment shown here, the electronic processing device 264 may include an ignition signal output 270 for providing a discharge control signal to the ignition switch 254, a first thermal signal output 272 for providing a control signal to the transistor 258, and a second thermal signal input 274 for receiving a control signal from the second thermal switch. The device 264 may also include a stop input 276 coupled to an optional stop switch (not shown), which acts as a manual override for shutting down the engine 200. It should be appreciated that numerous circuit arrangements, including ones other than the exemplary arrangement shown here, could be used to process, condition, or otherwise improve the quality of signals used herein.

Figure 8:
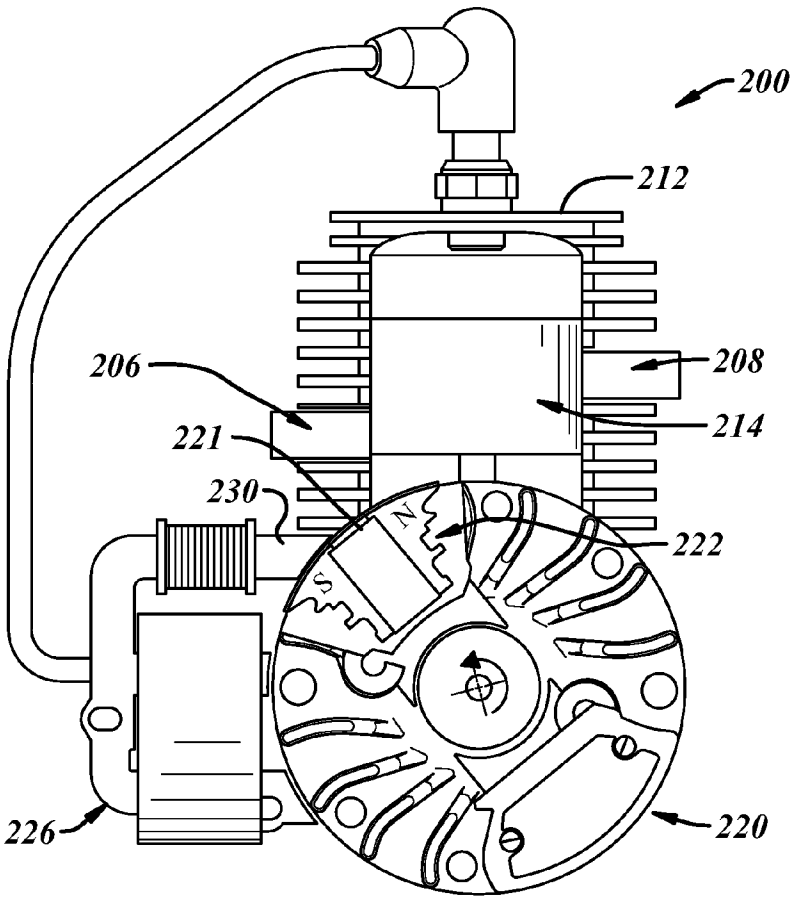
FIG. 8 is a partial schematic view of the engine of FIG. 6, illustrating an initially opened intake passage position of the piston and the magneto device.

Referring to FIG. 8, the piston 214 has moved further toward the cylinder head 212 such that the intake passage 206 is initially opened and the exhaust passage 208 is being further closed. Also, the flywheel 220 has continued to rotate counterclockwise such that the magnet group 222 overlaps the first leg 230 of the lamstack 226. The position of the piston 214 and flywheel 220 in FIG. 8 corresponds to approximately 59 degrees before top dead center (BTDC) of the piston 214. Also, the position of the piston 214 and flywheel 220 of FIG. 8 approximately corresponds to the FIG. 8 line in FIG. 11, wherein electromechanical valve current has started to reverse direction as the axis of the first pole 221 has just passed the axis of the first lamstack leg 230, and vacuum through the intake passage 206 is initiated due to the initial opening of the intake passage 206.

Figure 9:
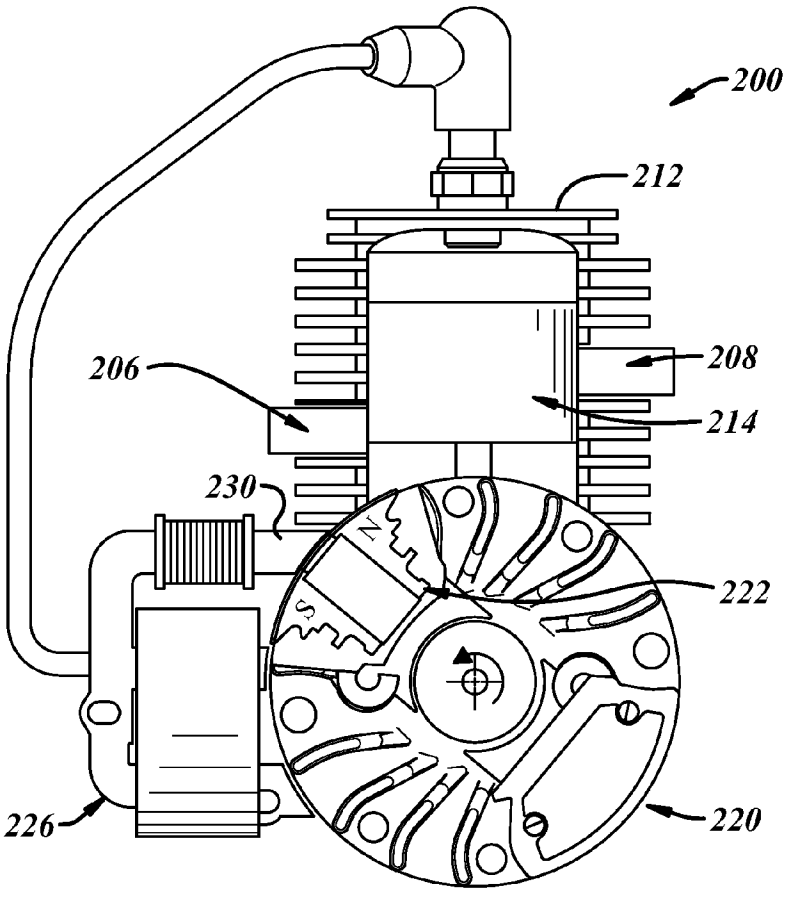
FIG. 9 is a partial schematic view of the engine of FIG. 6, illustrating a peak intake passage vacuum condition of the piston and the magneto device.

Referring to FIG. 9, the piston 214 has moved even further toward the cylinder head 212 such that the exhaust passage 208 is now closed and the intake passage 206 is now opened to the point at which vacuum through the intake passage 206 is substantially at a maximum. Also, the flywheel 220 has further continued to rotate counterclockwise such that the magnet group 222 is generally aligned with the first leg 230 of the lamstack 226.

The valve power coil 232 and the flywheel magnet group 222 are arranged in relation to the position of the piston 214 where vacuum through the intake passage 206 peaks. For example, the electromechanical valve 86 is powered within about 80% of peak engine intake vacuum and, more particularly may be powered within about 90% of peak engine intake vacuum. In another example, the electromechanical valve 86 opens when the intake passage 206 reaches an opening amount of about 10% to 20% of full opening and, more particularly about 15% to 16% of full opening. In a further example, the position of the piston 214 and flywheel 220 in FIG. 9 corresponds to about 40 to 60 degrees BTDC of the piston 214 and, more particularly about 51 degrees BTDC of the piston 214.

As shown in FIG. 11, the position of the piston 214 and flywheel 220 of FIG. 9 approximately corresponds to the FIG. 9 line in FIG. 11, wherein electromechanical valve current reaches a level sufficient to power the valve 86 as the magnet M approximately aligns with the axis of the first lamstack leg 230, and vacuum through the intake passage 206 begins to peak. As also shown in FIG. 11, the electromechanical valve control signal has changed state substantially in correspondence with the electromechanical valve current. About 65% to 75% of peak current produced by the valve power coil 232 for the valve 86 and, more particularly about 70% of peak current, is initially used to open the valve 86 and corresponds to about 380 mA in the exemplary embodiment disclosed herein.

The degree to which the electromechanical valve 86 stays on is dependent on engine speed and may increase with cranking speed, but may stay on for a minimum of about 10 degrees of crank angle, and may be on for up to about 72 degrees of crank angle, which equates to about 40% of the 180 degrees of the compression stroke. In the exemplary engine environment disclosed herein, at about 1,500 RPM the valve power coil 232 reaches peak current output and can maintain the electromechanical valve 86 in an energized state for about 10 to 72 degrees of crank angle. The valve 86 may stay open until the current falls below, for example, about 50 mA.

Figure 10:
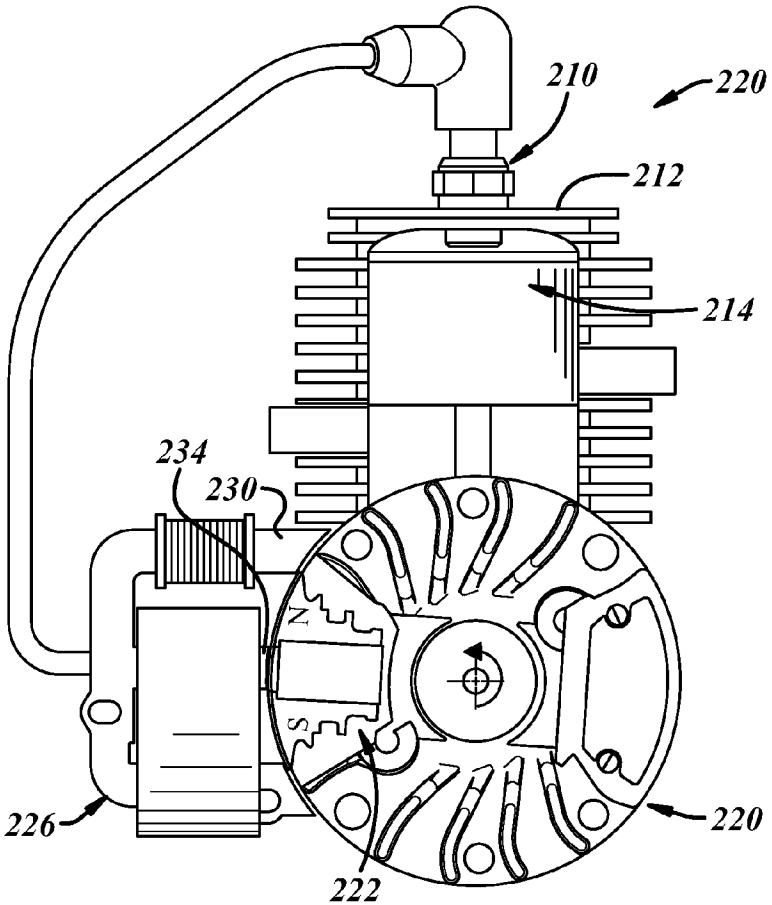
FIG. 10 is a partial schematic view of the engine of FIG. 6, illustrating a maximum opened intake passage position of the piston and the magneto device.

Referring to FIG. 10, the piston 214 has moved still further toward the cylinder head 212 such that the both the intake and exhaust passages 206, 208 are closed and the spark plug 210 fires to ignite the air-and-fuel mixture in the combustion chamber and force the piston 214 to reverse direction and move away from the cylinder head 212.

Timing of the firing of the spark plug 210 varies with engine RPM, is specified in terms of its relationship to piston top-dead-center (TDC), and can be delayed with respect to TDC. For example, spark plug firing may be delayed to about 6 to 24 degrees BTDC, which corresponds in the exemplary engine to about 35 to 53 degrees delay, for instance, after the intake passage opens or after vacuum through the intake passage 206 substantially reaches a maximum.

Also, the flywheel 220 has further rotated further counterclockwise such that the magnet group 222 is generally aligned with the second leg 234 of the lamstack 226. The position of the piston 214 and flywheel 220 in FIG. 10 corresponds to approximately 8 degrees BTDC of the piston 214. Also, the position of the piston 214 and flywheel 220 of FIG. 10 approximately corresponds to the FIG. 10 line in FIG. 11, wherein an ignition output current spikes when the spark plug 210 is fired.

Figure 12:
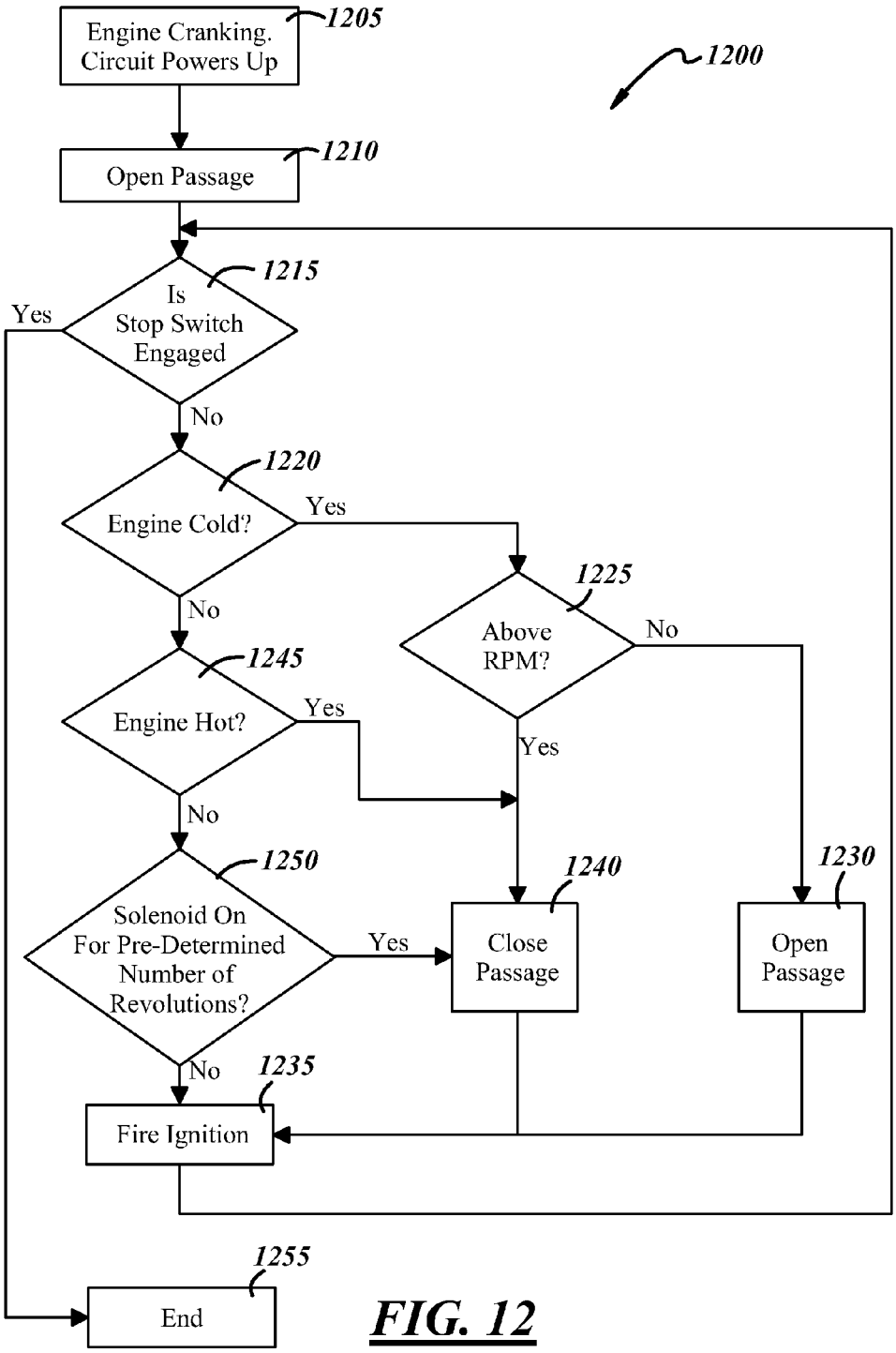
FIG. 12 is a flow chart of a presently preferred form of a method of controlling air and fuel supply to an engine.

FIG. 12 illustrates an exemplary method 1200 of controlling supply of supplementary fuel for an engine, as discussed in detail below. Also, portions of the method 1200 will be described in reference to FIGS. 1 through 11. The method steps may or may not be sequentially processed, and the invention encompasses any sequencing, overlap, or parallel processing of such steps.

At step 1205, the method 1200 may commence in any suitable manner. For example, the engine 200 may be cranked in an attempt to startup the engine 200 so that it runs on its own. More specifically, the engine 200 may be manually cranked such as by an operator pulling on a manual recoil starter (not separately shown). During engine cranking, the flywheel 220 rotates and the magnet group 222 and the lamstack cooperate to produce electrical power.

At step 1210, a supplementary fuel supply passage may be opened. For example, a valve may be powered. More specifically, electrical power may be communicated to the electromechanical valve 86 to unseat the valve member 108 and allow fuel to flow from the fuel chamber 72 to the air-and-fuel mixing passage 34

At step 1215, it may be determined whether or not a stop switch is activated. If so, the method terminates at step 1255. If not, the method proceeds to step 1220.

At step 1220, it may be determined whether or not an engine temperature meets an engine temperature criteria. For example, the engine temperature criteria may be a first of two or more engine temperature criteria in the method 1200. The criteria may be a low or cold engine temperature criteria, for instance, an engine temperature range or threshold value, for example, of between about 30 to about 50 degrees Fahrenheit and, more particularly, about 40 degrees. Of course, such temperature values and ranges are engine application specific, vary with carburetor settings for the particular application, and may be determined during calibration of carburetor prototypes in thermal chamber testing. The determination may include sensing engine temperature, for instance, using thermal switches, temperature sensors, thermocouples, or any other suitable devices and associated equipment like processors, memory, and the like.

If the engine temperature does not meet the cold engine temperature criteria, then the method proceeds to step 1245. But if so, then the method branches to step 1225.

At step 1225, it may be determined whether or not an engine speed meets engine speed criteria. For example, the engine speed criteria may be low engine speed criteria, for instance, between about 1,000 and 2,000 RPM and, more particularly, may be about 1,700 RPM. The low speed criteria and ranges are engine application specific, and may be determined during carburetor calibration and may correspond to a lowest engine speed at which the engine idles smoothly. Engine speed may be determined in any suitable manner, for example, an engine speed sensor (not shown) may be operatively coupled to the crankshaft, the flywheel, or the like in any suitable manner, or one or more of the lamstack coils 232, 236, 242, 244 may be used to track engine revolutions in any suitable manner.

If engine speed does not meet the engine speed criteria, then the method proceeds to step 1230. Otherwise, the method proceeds to step 1240.

At step 1230, a supplementary fuel supply passage may be initially opened or maintained in an open state. For example, electrical power is communicated to the electromechanical valve 86 to unseat the valve member 108 and allow fuel to flow from the fuel chamber 72 to the air-and-fuel mixing passage 34. Thus, when the engine 200 is relatively cold, the electromechanical valve 86 is activated not only during cranking but also at any time engine speed falls below low speed criteria.

At step 1235, a spark plug may be fired. For example, the electronic processing device 264 may send an ignition signal to the switch 254 to fire the spark plug 210.

At step 1240, a supplementary fuel supply passage may be closed. For example, electrical power to the electromechanical valve 86 is terminated or kept off to seat the valve member 108 or keep it seated and prevent fuel from flowing from the fuel chamber 72 to the air-and-fuel mixing passage 34. In one embodiment, the electronic processing device 264 may cease output of the valve-on control signal. In another embodiment, the valve-on control signal from the electronic processing device 264 may be shorted to ground when the thermistor 256 conducts. After step 1240, the method loops back just before step 1215.

At step 1245, it may be determined whether or not an engine temperature meets additional engine temperature criteria. For example, the additional engine temperature criteria may be a warm or hot engine temperature, for instance, of about 75 to about 95 degrees Fahrenheit and, more particularly, about 85 degrees. Again, such temperature values and ranges are engine application specific, vary with carburetor settings for the particular application, and may be determined during carburetor calibration in a thermal chamber to correspond to a temperature at which the engine can be started and idle smoothly without additional enrichment from the electromechanical valve 86. The determination may include sensing engine temperature, for instance, using thermal switches, temperature sensors, thermocouples, or any other suitable devices and associated equipment like processors, memory, and the like.

If the engine temperature does not meet the additional engine temperature criteria, then the method proceeds to step 1250. But if so, then the method branches to step 1240, because a warm engine should not require supplementary fuel for startup. The A/F ratio of hot, running engine is generally leaner than the A/F ratio to reliably start a cold engine.

At step 1250, it may be determined whether or not a supplementary fuel supply passage has been open for more than a determined number of engine revolutions. Engine revolutions may be assessed in any suitable manner, for example, using any suitable counter with any suitable input such as that from an engine speed sensor, or one or more of the coils. The minimum number may be, for example, about 10 to 20 revolutions and, more specifically, about 15 revolutions. The number may be determined by engine testing as the maximum number of revolutions below the high temperature criteria that does not result in engine flooding.

In some cases an engine may fail to start quickly and, because the supplementary fuel supply passage may remain open, the start fuel may continue to be supplied to the engine 200, thereby potentially "flooding" the spark plug 210 in the combustion chamber of the engine 200 with an excessively rich mixture of air and fuel. Once the spark plug 210 becomes flooded, the engine 200 may be difficult or impossible to start, and the operator must wait until the fuel evaporates from the spark plug 210 before trying to start the engine 200 again.

If the supplementary fuel supply passage has been open for more than the determined number of engine revolutions, then the method may proceed to step 1240. Otherwise, the method proceeds to step 1235, whereafter the method may loop back to step 1215.

At step 1255, the method 1200 may terminate in any suitable manner. For example, the method terminates if the stop switch is engaged, if the engine revolutions are insufficient to power the circuit, and/or the like.

Figure 13A:
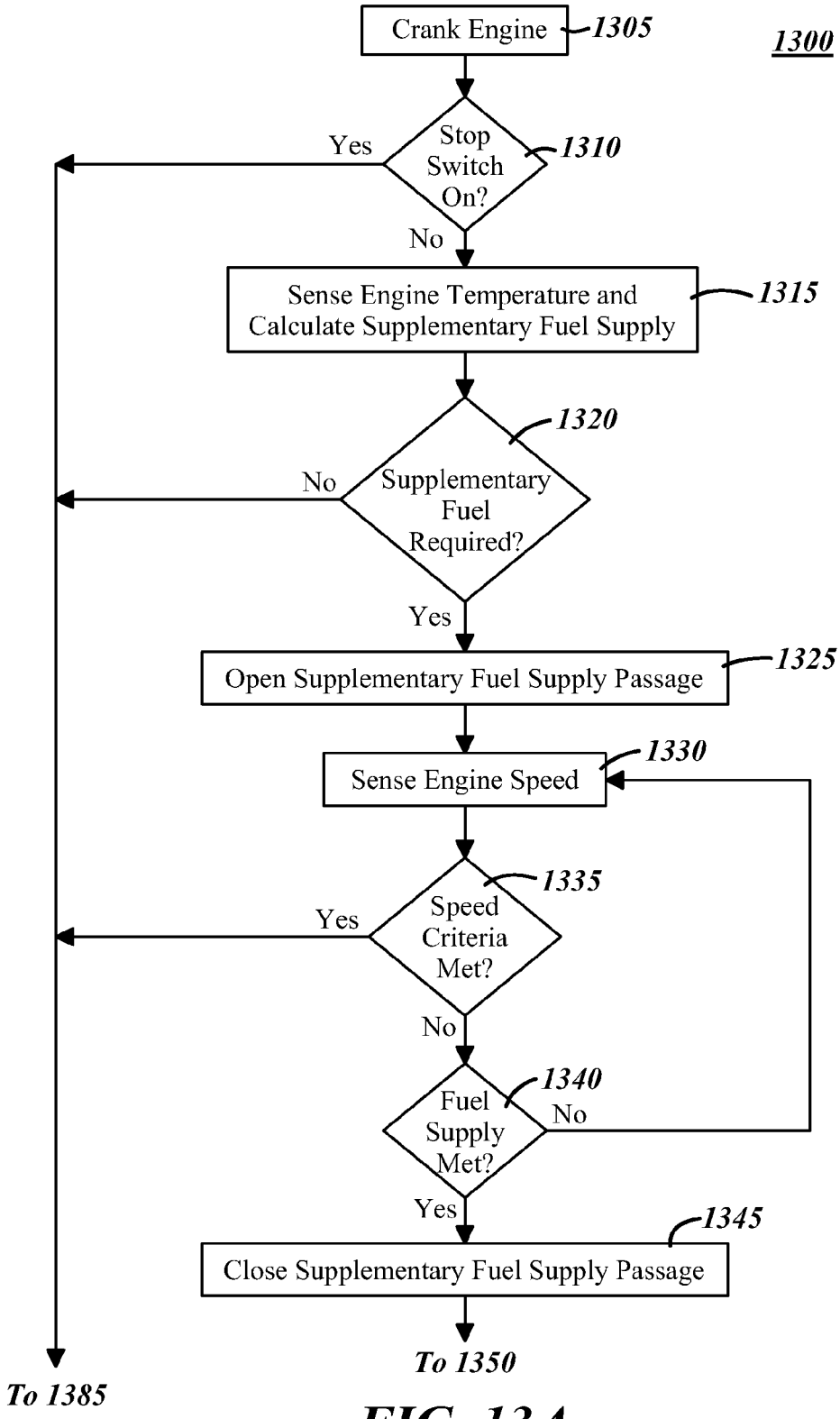
FIG. 13A is a portion of a flow chart of another presently preferred form of a method of controlling supply of supplementary fuel through a supplementary fuel supply passage in a carburetor for an engine.
Figure 13B:
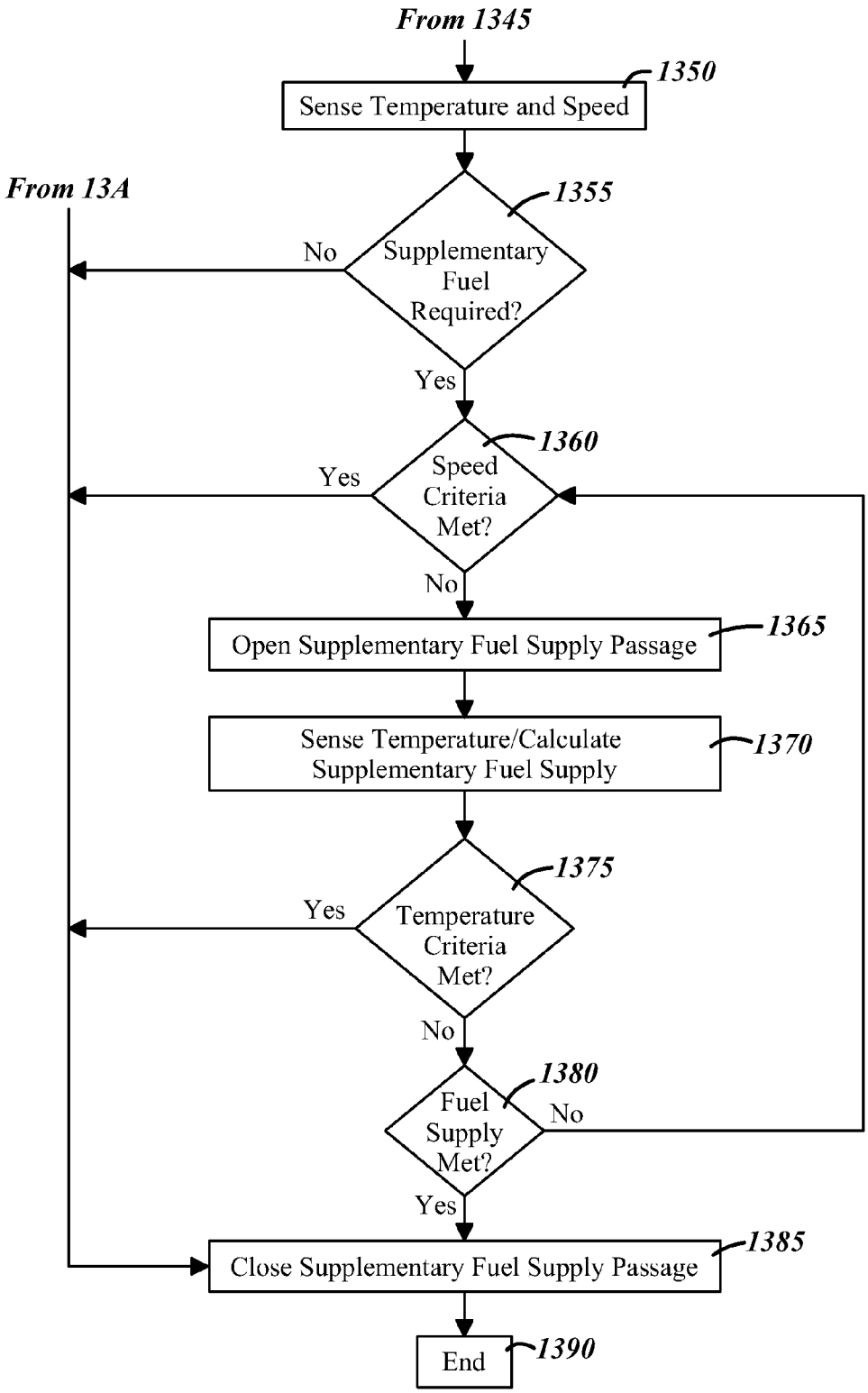
FIG. 13B is another portion of the flow chart of FIG. 13B.

FIGS. 13A and 13B illustrate another presently preferred form of a method 1300 of controlling supply of supplementary fuel for an engine. This form is similar in many respects to the form of FIG. 12 and like numerals between the forms generally designate like or corresponding steps throughout the several views of the drawing figures. Accordingly, the descriptions of the methods 1200 and 1300 are incorporated into one another by reference in their entireties. Additionally, the description of the common subject matter generally may not be repeated here.

FIGS. 13A and 13B illustrate an exemplary method 1300 of controlling supply of supplementary fuel for an engine, as discussed in detail below. Also, portions of the method 1300 will be described in reference to FIGS. 1 through 11. The method steps may or may not be sequentially processed, and the invention encompasses any sequencing, overlap, or parallel processing of such steps.

FIG. 13A illustrates a routine of the method 1300 for supplying supplementary fuel during engine cranking. FIG. 13B illustrates another routine of the method 1300 for further supplying supplementary fuel after engine cranking and during engine warmup.

Referring now to FIG. 13A, at step 1305, the method 1300 may commence in any suitable manner. For example, the engine 200 may be cranked in an attempt to startup the engine 200 so that it runs on its own. More specifically, the engine 200 may be manually cranked such as by an operator pulling on a manual recoil starter (not separately shown). During engine cranking, the flywheel 220 rotates and the magnet group 222 and the lamstack cooperate to produce electrical power.

At step 1310, it may be determined whether or not an engine stop switch is activated. If so, the method proceeds to step 1385. If not, the method proceeds to step 1315.

At step 1315, engine temperature may be sensed and a supply of supplementary fuel during engine cranking may be determined. For example, upon engine cranking and within about the first two to three revolutions of an engine crankshaft, engine temperature may be sensed, crankshaft revolutions may be counted, and a number of crankshaft revolutions remaining over an engine cranking cycle may be calculated. For example, an engine cranking cycle may include six revolutions. So, for instance, if two crankshaft revolutions have been counted by the time the engine temperature is sensed, then the supply of supplementary fuel is determined to be carried out over the next four crankshaft revolutions. This is because six cranking revolutions minus two counted revolutions equals four revolutions.

At step 1320, a determination is made whether or not supplementary fuel is required during engine cranking. For example, the engine temperature sensed in step 1315 may be used in a comparison with engine temperature criteria, for instance, a certain minimum engine startup temperature. In one example embodiment, if the sensed engine temperature does not meet the criteria, then the method proceeds to step 1325, otherwise the method proceeds to step 1385.

At step 1325, a supplementary fuel supply passage may be opened. For example, the electromechanical valve 86 may be powered.

At step 1330, engine speed may be determined. For example, an engine speed sensor may be used to sense engine speed, or lamstack coils and suitable circuitry may be used to determine engine speed, or the like. Using lamstack coils to count engine revolutions and circuitry to calculate engine speed as a function of revolutions per time is well known to those of ordinary skill in the art.

At step 1335, it may be determined whether or not engine speed meets engine speed criteria. For example, the engine speed may be that determined in step 1330, and the criteria may be a minimum engine speed startup criteria, for instance, between about 1,000 and 2,000 RPM and, more particularly, may be about 1,700 RPM. If the engine speed criteria is met, then the method proceeds to step 1340, otherwise, the method proceeds to step 1385.

At step 1340, it may be determined whether or not a determined amount of supplementary supply of fuel for engine cranking has been reached. For example, if a sixth revolution of engine cranking has been determined to have occurred, then it can be determined that the determined amount of supplementary supply of fuel determined in step 1315 has been reached. If not, then the method loops back to step 1330. But if so, then the method proceeds to step 1345.

At step 1345, a supplementary fuel supply passage may be closed. For example, the valve 86 may be depowered. Thereafter, the method proceeds to step 1350.

At step 1350, engine temperature and/or speed may be sensed in any suitable manner.

At step 1355, a determination is made whether or not further supplementary fuel is required after engine cranking and during an engine warm-up period. For example, the engine temperature sensed in step 1350 may be used in a comparison with engine temperature criteria that may be the same as or different from that discussed in step 1320. If the sensed engine temperature meets the criteria, then the method proceeds to step 1360, otherwise the method proceeds to step 1385.

At step 1360, it may be determined whether or not engine speed meets engine speed criteria. For example, the engine speed may be that determined in step 1350, and the engine speed criteria may be the same as that or different from the engine speed criteria of step 1335. If the criteria is met, then the method proceeds to step 1365, otherwise, the method proceeds to step 1385.

At step 1365, a supplementary fuel supply passage may be opened. For example, the electromechanical valve 86 may be powered.

At step 1370, engine temperature may be sensed and a further supply of supplementary fuel during engine warm-up may be determined For example, after engine cranking and during an engine warm-up period, engine temperature may be sensed, and a calculation can be made of warm-up parameters such as a fuel supply duration or quantity of crankshaft revolutions, and a fuel supply cycle length or frequency of revolutions over which the further supply of supplementary fuel is desired.

The following examples are for illustration and not limitation. The frequency may be calculated to be, for instance, every sixth crankshaft revolution, and the quantity or duration may be calculated to be, for instance, one to four crankshaft revolutions over which the further supply of supplementary fuel is provided for every determined cycle length.

Such parameters may be calculated as a function of engine temperature and/or speed. For instance, supplementary fuel may be provided over a greater number of revolutions and more frequently for lower engine temperatures and/or speeds, and vice versa.

At step 1375, it may be determined whether or not engine temperature meets engine temperature criteria. For example, the engine temperature may be that sensed in step 1370 and the criteria may be same or different from that of step 1355. If the sensed engine temperature meets the criteria, then the method proceeds to step 1380, otherwise the method proceeds to step 1385.

At step 1380, it may be determined whether or not a determined amount of a further supply of supplementary fuel for engine warmup has been reached. For example, if the number of revolutions determined in step 1370 was four, and it has been determined that four revolutions have occurred since step 1370, then it can be determined that the amount of further supply of supplementary fuel determined in step 1370 has been reached. If not, then the method loops back to step 1360. But if so, then the method proceeds to step 1385.

At step 1385, a supplementary fuel supply passage may be closed. For example, the valve 86 may be depowered. Thereafter, the method proceeds to step 1390.

At step 1390, the method terminates in any suitable manner.

Figure 14:
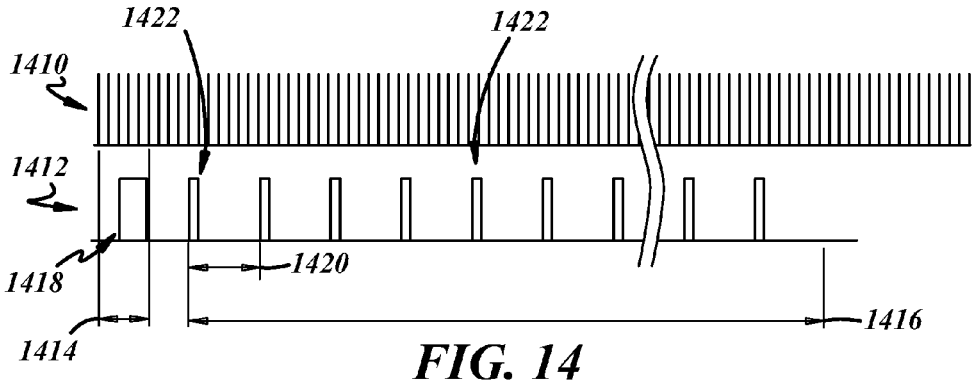
FIG. 14 is an example graphical representation of one example of the method of FIGS. 13A and 13B.

FIG. 14 illustrates an example graphical representation of one example of the method 1300 of FIGS. 13A and 13B. The graph includes a plurality of engine revolution pulses 1410, and a plurality of valve open pulses 1412. The graph also illustrates an engine cranking period 1414, and an engine warmup period 1416. A single valve open pulse 1418 is illustrated as occurring over the last four engine crankshaft revolutions of the cranking period 1414. A plurality of cycles 1420 may repeat over the engine warmup period 1416, and a plurality of valve open pulses 1422 are illustrated as occurring over the engine warmup period 1416.

In the routine illustrated in FIG. 13B and as illustrated in FIG. 14, supplementary fuel may be intermittently supplied, for example in a determined amount and frequency, so long as engine temperature does not meet engine temperature criteria and so long as engine speed does not meet engine speed criteria. Such intermittent supply of supplementary fuel may be carried out for no longer than an engine warm-up period for any given engine start.

Figure 15:
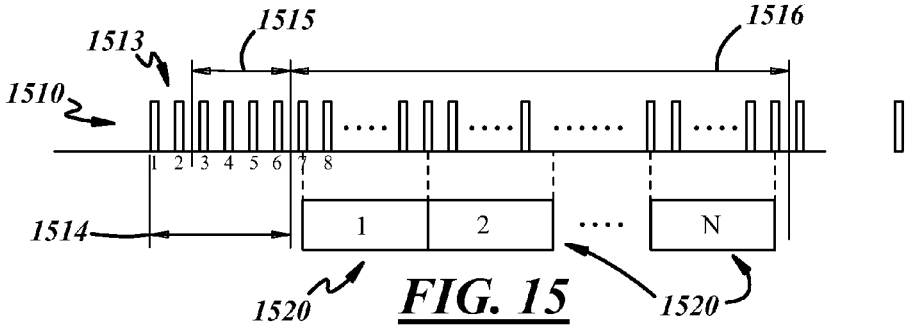
FIG. 15 is another example graphical representation of another example of the method of FIGS. 13A and 13B.

FIG. 15 illustrates another example graphical representation of another example of the method 1300 of FIGS. 13A and 13B. The graph includes a plurality of engine revolution pulses 1510, an engine cranking period 1514, and an engine warm-up period 1516. The engine cranking period 1514 includes an initial phase 1513 over a first two engine revolutions and a supplementary fuel supply phase 1515 over a subsequent four engine revolutions. The engine warm-up period 1516 includes N number of cycles 1520 over which the routine of method steps 1350 through 1385 of method 1300 of FIG. 13 may occur. For each of the cycles 1520, supplementary fuel may be supplied, for example, according to steps 1360 through 1380.

Figure 16:
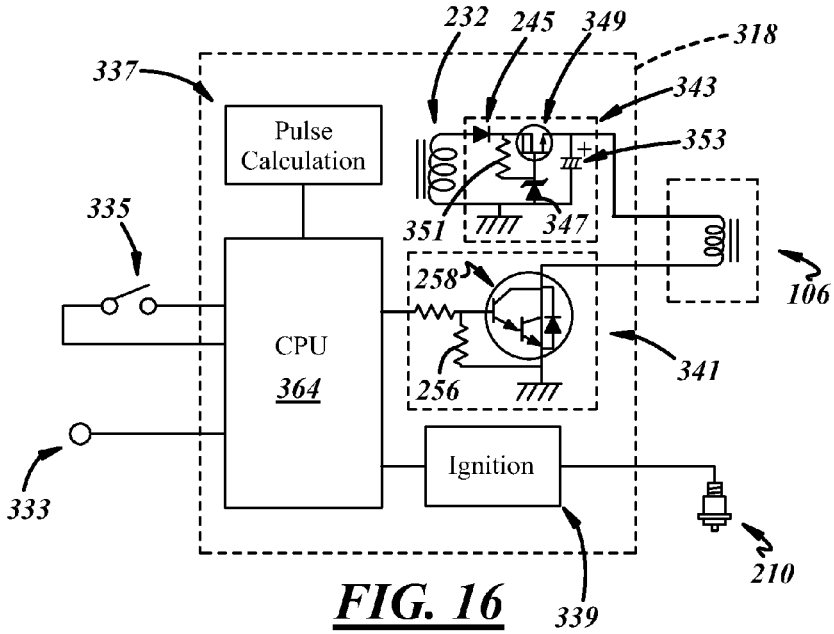
FIG. 16 is a block and schematic diagram for control of ignition and supplementary fuel supply.

FIG. 16 illustrates another presently preferred form of a power and control module (PCM) 318 and related components. This form is similar in many respects to the form of FIG. 7 and like numerals between the forms generally designate like or corresponding steps throughout the several views of the drawing figures. Accordingly, the descriptions of the PCMs 218, 318 are incorporated into one another by reference in their entireties. Additionally, the description of the common subject matter generally may not be repeated here.

In addition to the PCM 318, FIG. 16 also illustrates a temperature sensor 333 to sense engine temperature, a stop switch 335 to stop engine operation, the solenoid coil 106, the spark plug 210, and the valve power coil 232. The PCM 318 includes a pulse calculation block 337, which may represent suitable instructions for supplying supplementary fuel that may be executed by an electronic processing device 364 of the PCM 318. For example, the pulse calculation block 337 may represent the methodology described above with respect to methods 1200 and/or 1300.

The PCM 318 also includes an ignition block 339, which may include ignition circuitry similar to that described above with respect to FIG. 7. For example, the ignition block 339 may include the charge coil 236, the transformer 240, the ignition capacitor 252, and the switching device 254 of FIG. 7. In another example, the ignition block 339 may include any other suitable ignition circuitry.

The PCM 318 further includes a thermal switch 341 that may include the thermistor 256 and the transistor 258 to interrupt current flow to the solenoid coil 106 so as to terminate supplementary fuel supply when engine temperature exceeds a certain value.

Finally, in contrast to the PCM 218 of FIG. 7, here the PCM 318 includes a rectifying circuit 343 interposed between the valve power coil 232 and the solenoid coil 106. The valve power coil 232 has a negative pole to ground and a positive pole coupled in series to a diode 345 of the rectifying circuit 343. The circuit 343 also includes a zener diode 347 and an field-effect transistor (FET) 349 in parallel with the power coil 232 downstream of the diode 345, a resistor 351 in parallel across the FET 349 and having ends connected downstream of the diodes 345, 347, and a capacitor 353 in parallel with the power coil 232 downstream of the zener diode 347 and the FET 349.

The rectifying circuit 343 provides power to the coil 106 for the solenoid valve, may stabilize and retain suitable voltage in so doing, and may also protect electronic one or more components of the PCM 318 for long life and increased durability thereof. Those of ordinary skill in the art will recognize that the particular sizes and capacities of the components of the rectifying circuit 343 may be application specific and provided in accord with desired solenoid valve opening timing.

In general, the components of the engine and carburetor can be manufactured according to techniques known to those skilled in the art, including molding, machining, stamping, and the like. Also, the carburetor can be assembled according to known techniques. Likewise, any suitable materials can be used in making the components, such as metals, composites, polymeric materials, and the like.

A system for supplemental fuel supply also can be utilized to control engine temperature and/or speed at relatively high engine temperature and speeds, instead of or in addition to the starting and warm-up periods already discussed. In at least some engine applications, it may be desirable to provide a fuel and air mixture to the engine that is richer than is required for steady operation of the engine (e.g. richer than a stoichiometric fuel/air ratio) to help cool the engine in use. However, the richer fuel/air mixture can lead to undesirable exhaust emissions from the engine. Operating with a leaner fuel/air ratio can reduce emissions but may also lead to higher than desired engine temperatures. In some instances of high speed and/or high load engine operation (e.g. in use of a chainsaw or the like), the engine temperature in at least a portion of the engine may be high enough to cause unintended combustion within an engine cylinder. This unintended combustion can lead to higher than intended or desired engine speed, increased temperature and potentially further unintended combustion events which may lead to seizing of the engine.

To deal with this potential issue, one solution is to skip an intended engine ignition event (e.g. not provide a spark at the spark plug so emission does not occur when it otherwise would occur). However, unburned fuel may be discharged through the exhaust system and can damage or impair a catalyst or other engine or exhaust component or system when an ignition event or multiple ignition events are skipped. Another possible solution is to retarding or delaying ignition events to slow down the engine. However, the temperature of exhaust gas emissions can increase undesirably and damage or impair the catalyst or other engine or exhaust component or system.

Figure 17:
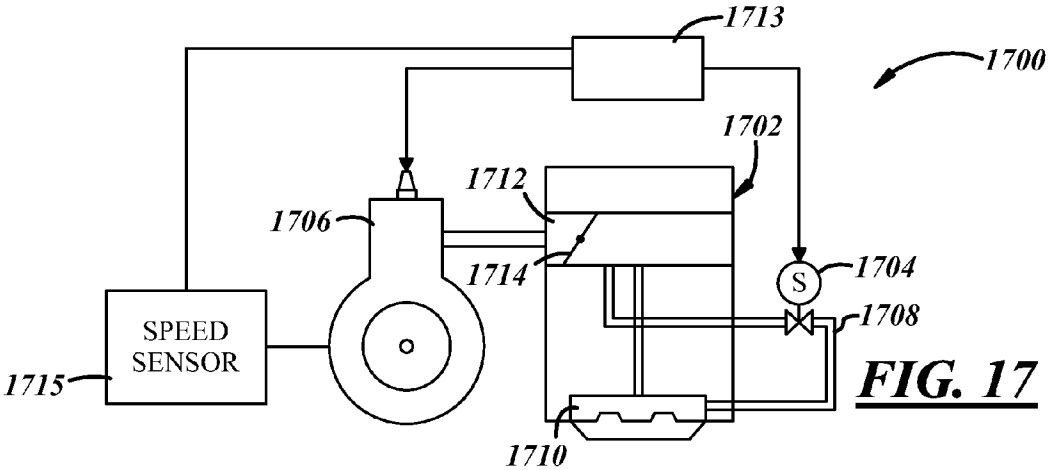
FIG. 17 is a diagrammatic view of an engine and a fuel system for the engine.

As shown in FIG. 17, an exemplary fuel supply system 1700 includes a primary fuel supply device (shown as a carburetor 1702) and a supplementary fuel supply device 1704. The supplementary fuel supply device 1704 may include a valve through which fuel may flow for delivery to the engine 1706 under certain engine operating conditions. That is, during certain engine operating conditions, the valve 1704 may be opened to permit fuel to flow through or past the valve for delivery to the engine 1706 of a supplementary supply of fuel. In one form, the valve 1704 is normally closed so that essentially no fuel flows past or through the valve, but the valve could normally be partially open and then opened further to enable a higher flow rate of fuel therethrough when desired. In that case, normal fuel flow would include fuel flow through the valve 1704 and supplemental fuel would be provided to the engine when the valve is further opened.

Like the previous embodiment which related more to starting and engine warm-up, the valve 1704 may control fuel flow through a supplemental fuel passage 1708 or passages where fuel from the metering chamber 1710 of the carburetor 1702 may be supplied to the engine 1706. The supplementary fuel passage 1708 may open into or communicate with the fuel and air mixing passage 1712, and may as one example, provide fuel into the fuel and air mixing passage at a location downstream of a venturi (if one is provided in the fuel and air mixing passage). The supplementary fuel passage 1708 may open into the fuel and air mixing passage downstream of the throttle valve 1714, at least when the throttle valve is in its idle position. Also like the previous embodiment, the valve timing can be controlled by a microprocessor or other controller 1713 that also controls the ignition timing, and the valve may be powered by a coil integrated into the ignition module, such as the valve power coil. The valve 1704 may be electrically actuated, such as a solenoid, piezoelectric (bending, rotary or linear actuators), ultrasonic piezoelectric such as are available from Discovery Technology International, Inc., voice coil actuator or similar type of valve.

The duration that the valve 1704 is opened, or the number of times the valve is cycled (opened and closed) may vary as a function of the engine speed and/or engine temperature. For example, when the engine speed exceeds a first threshold (as determined by an engine speed sensor 1715 or other device or method), the valve 1704 may be opened for a given duration which may be a certain number of engine revolutions. If the engine speed exceeds a second threshold higher than the first threshold, the valve 1704 may be opened for a longer duration which may be a certain higher number of engine revolutions. Still further engine speed thresholds may be provided to provide for different valve opening durations or cycles, to provide a desired amount of supplemental fuel to the engine. The engine speed may be checked periodically including every revolution, or every cycle of the engine, and the supplemental fuel may be provided as a result, assuming the engine speed is faster than a first or lowest threshold. If the engine speed is not faster than a first threshold, then the valve 1704 may remain in its first position (e.g. closed, or its most closed position).

Figure 18:
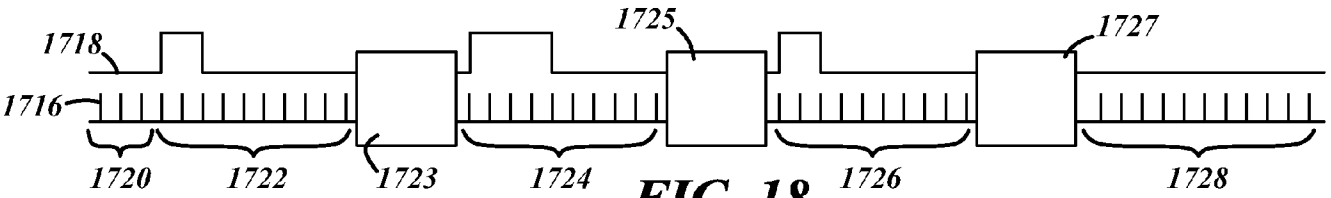
FIG. 18 is an example graphical representation of a method of providing supplementary fuel to an engine.

In one exemplary implementation, as shown in FIG. 18, engine revolutions are shown at 1716 and a control signal for opening and closing the valve is shown at 1718. In this example, the first threshold is 12,000 rpm and in phase one 1720 the engine speed is below 12,000 rpm. Accordingly, the valve is maintained closed or in its first position. In this example, when operating normally, the engine speed may be below the first threshold, and so the valve would normally be closed (or in its first position) and the supplemental fuel would not be provided to the engine. In phase two 1722, the engine speed is detected as being over 12,000 rpm. In this phase, the valve 1704 is opened (moved to its second positions) for two out of every 9 engine revolutions, where a cycle has been deemed to include 9 revolutions in this example. This may occur for a certain number of cycles, for example 1-10 cycles as represented by the box 1723 in FIG. 18, and the engine speed may be checked again. If the engine speed is below the first threshold (12,000 rpm in this example), the valve 1704 is no longer driven to its open position for as long as the engine speed remains below the first threshold.

If, however, the engine speed is above a second threshold which is higher than the first threshold, then the valve 1704 may be opened for a greater duration, or cycled more frequently than in phase two 1722. In the example shown, the second threshold may be 13,000 rpm and operation of the valve 1704 when the engine speed is greater than the second threshold is shown in FIG. 18 at phase three 1724. In other words, despite adding the supplemental fuel in phase two 1722, the engine speed increased in this example. In phase three 1724, the valve 1704 may be opened for a greater duration each cycle than the valve was opened in phase two 1722. For example, the valve 1704 may be opened for 4 revolutions each cycle during phase three 1724 as opposed to two revolutions as in phase two 1722. This may also occur for a given number of cycles, as represented by box 1725, before the engine speed is checked again, or the engine speed may be determined or checked every cycle.

After phase three 1724, and in phase four 1726, the engine speed was between the first and second thresholds. As shown in FIG. 18, the valve 1704 may then be operated similarly to phase two 1722, and this may occur for a given number of cycles (represented by box 1727) which may be the same as in phase two, as desired. If, after phase four 1726, the engine speed is below the first threshold, then the valve 1704 is not driven to its second position (in this example), as shown in phase five 1728 and supplemental fuel is not provided through the valve 1704. If, after phase three 1724, the engine speed increased further, beyond a third threshold, then the valve 1704 could be operated in such a manner as to provide even more supplemental fuel to the engine, if desired. In one example, the third threshold could be 14,000 rpm. In addition to the supplemental fuel delivery, the ignition timing could be changed when the engine speed is above any of the thresholds, if desired. Also if desired, one or more ignition events could be skipped in addition to supplying supplemental fuel. This may include skipping a sufficient number of ignition events to shut down the engine 1706 should the engine speed exceed a given speed threshold, such as either the third threshold or an even higher threshold.

Figure 19:
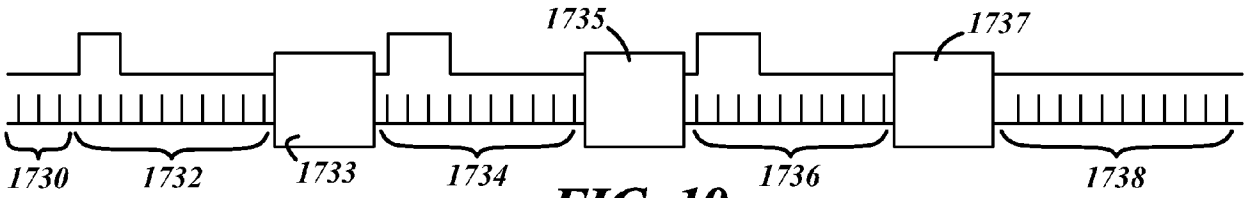
FIG. 19 is an example graphical representation of a method of providing supplementary fuel to an engine.

Another exemplary control chart is shown in FIG. 19. In the first phase 1730 of this control scheme, the engine speed is below a threshold speed and so no supplemental fuel is provided to the engine 1706. In phase two 1732, the engine speed is higher than the threshold speed and a first amount of supplemental fuel is added by moving the valve 1704 to its second position (opening or further opening the valve). In the example shown, the valve 1704 is open for 2 out of 9 revolutions and this may be repeated for a desired number of cycles (e.g. 1 to 10 or more represented by box 1733). After the desired number of cycles are completed, the engine speed can again be determined or checked. If the engine speed still is above the threshold speed, then more supplemental fuel may be provided to the engine in phase three 1734. In the example shown, supplemental fuel is provided for 3 out of 9 revolutions in phase three 1734 and this may be repeated for a desired number of cycles (e.g. 1 to 10 or more represented by box 1735). If the engine speed is still above the threshold speed, still further supplemental fuel may be provided to the engine in phase four 1736. Additionally, the engine speed for two revolutions, for example, each of the last two revolutions in phase three 1734, can be compared. And the amount of supplemental fuel added in phase four 1736 can be controlled as a function of the engine speed during these compared revolutions. If, for example, the last revolution was slower than the second-to-last revolution, meaning the engine 1706 is slowing down, then the supplemental fuel may be added at the same rate/duration as in phase three 1734 (e.g. the valve may be opened 3 out of 9 revolutions) to achieve further engine speed reduction. If the last revolution was faster than or the same speed as the second-to-last revolution, meaning the engine speed is increasing or at least not decreasing, then an increased amount of supplemental fuel may be added in phase four 1736 (e.g. the valve may be opened 4 out of 9 revolutions). This may be repeated for any desired number of cycles as represented by box 1737. In the example shown, the engine speed is below the threshold speed in phase five 1738 and so supplemental fuel is not supplied to the engine 1706. That is, the valve 1704 is not opened in phase five 1738.

Instead of opening the controlling the valve for a given number of engine revolutions, the valve could also be opened for a predetermined amount of time, or for an amount of time determined by the controller as a function of the instantaneous engine speed compared to one or more thresholds. Time and number of engine revolutions may be referred to as increments, and the supplementary fuel may be supplied to the engine over one or more increments, as desired.

As noted herein, the control scheme or method for supplying supplementary fuel to the engine may use multiple speed thresholds with a predetermined valve opening schedule. For example, based on which threshold the engine speed exceeds, the valve may be opened for a predetermined number of engine revolutions less than the total number of engine revolutions in a cycle (where the total revolutions in a cycle may also be predetermined). Where engine speeds above higher engine speed thresholds would cause more supplementary fuel to be supplied to the engine. And that control scheme may be repeated over a predetermined number of cycles before the engine speed is again compared to the threshold(s). In at least some implementations, supplementary fuel may be supplied to the engine for a greater number of cycles where the engine speed exceeds higher engine speed thresholds, and for fewer cycles where the engine speed exceeds only lower thresholds. Of course, the engine speed could be compared to the threshold(s) after every cycle, or for each engine revolution, or for selected engine revolutions within one or more cycles, if desired. A single engine speed threshold may also be used and the magnitude by which the instantaneous engine speed exceeds the threshold may determine the amount or rate of supplementary fuel supplied to the engine, where the greater the engine speed is compared to the threshold, the more supplementary fuel may be supplied to the engine.

For a given engine speed or range of speeds, the controller may determine, based on predetermined values in a programmed control schedule, table, chart, or an algorithm/formula (determination with an algorithm or formula may also be predetermined as used herein because the algorithm or formula will make a determination in a predetermined way), one or more of: 1) the number of revolutions in a cycle, 2) the number of revolutions (or total time) for supplementary fuel supply during a cycle, and/or 3) the number of cycles to repeat the supplementary fuel supply. Of course, other control schemes are possible and contemplated herein. As noted herein, the provision of supplementary fuel to the engine may help to control the engine temperature and engine speed within certain thresholds. In at least some implementations, the amount of supplemental fuel provided is controlled as a function of instantaneous engine speed and/or the magnitude by which the instantaneous engine speed exceeds one or more thresholds. In this way, unintended combustion events can be reduced or avoided altogether, among other things.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A method of controlling supply of supplementary fuel through a supplementary fuel supply passage in a carburetor for an engine, comprising:

providing an electromechanical valve in fluid communication with the supplementary fuel supply passage;

determining engine speed;

powering the electromechanical valve to supply supplemental fuel to the engine as a function of the engine speed when the engine speed is above a first threshold speed wherein the valve is powered if engine speed is above a threshold speed that is higher than a normal operating speed of the engine for at least one first cycle of a predetermined number of at least one first revolution out of a predetermined plurality of revolutions of the engine greater than the at least one first revolution;

determining a second engine speed after the at least one first cycle; and if the second engine speed is above a second threshold speed higher than the first threshold speed powering the electromechanical valve to supply supplemental fuel to the engine for at least one second cycle of a predetermined number of second revolutions greater than the at least one first revolution of the first cycle out of a predetermined plurality of revolutions of the engine greater than the number of second revolutions.

2. The method of claim 1 wherein the valve is powered by current created by a flywheel magnet group rotating past a coil on a leg of a magneto lamstack.

3. The method of claim 1 further comprising determining a third engine speed after the at least one second cycle, and if the third engine speed is above the second threshold speed powering the electromechanical valve to supply supplemental fuel to the engine for at least one third cycle of a greater number of third revolutions than the at least one first revolution out of a predetermined plurality of revolutions of the engine greater than the number of the at least one first revolution.

4. The method of claim 3 wherein the number of third revolutions is greater than the number of second revolutions.

5. The method of claim 4 wherein the predetermined at least one first revolution of the first cycle includes two or more engine revolutions.

6. The method of claim 5 wherein the at least one first cycle includes a plurality of not more than ten first cycles.

7. The method of claim 4 wherein the predetermined second revolutions of the second cycle includes at least three revolutions.

8. The method of claim 3 wherein the electromechanical valve is powered in the second cycle to provide a second amount of supplemental fuel supply to the engine when the engine speed is above the second threshold and the electromechanical valve is powered in the third cycle to provide a third amount of supplemental fuel supply to the engine that is greater than the second amount when the engine speed exceeds the second threshold.

9. The method of claim 1 wherein the electromechanical valve is powered for a predetermined number of a plurality of first cycles, and after said predetermined number of first cycles the second engine speed is determined and the electromechanical valve is further powered only if the engine speed still exceeds the second threshold.

10. The method of claim 1 wherein the first cycle is equal to a number of a plurality of engine revolutions determined as a function of the engine speed compared to the first threshold.

11. The method of claim 1 wherein the predetermined number of cycles is determined as a function of the engine speed compared to the threshold.

12. The method of claim 1, further comprising:

a carburetor having a fuel chamber, a mixing passage through which air and fuel are delivered to the engine and the supplementary fuel passage communicating the fuel chamber with the mixing passage;

the electromechanical valve normally closing the supplementary fuel passage; and a magneto device including a flywheel with a magnet group and a lamstack having a first leg carrying a coil, wherein the flywheel magnet group and the lamstack first leg are configured such that the electromechanical valve is powered to open the supplementary fuel passage by current created by the magnet group rotating past the lamstack first leg as engine speed exceeds the first threshold.

13. The method of claim 12, further comprising a speed sensor that enables determination of the engine speed, and a controller that compares the determined engine speed with the threshold and controls application of power to the electromechanical valve when the engine speed exceeds the first threshold.

14. The method of claim 13 wherein the controller also controls ignition timing for the engine.

15. The method of claim 13 wherein the controller opens the electromechanical valve for the at least one first cycle to supply supplemental fuel to the engine, where the the number of first revolutions or the number of first cycles or both is determined by the controller as a function of the determined engine speed compared to the first threshold speed.

* * * * *